US009586256B2

(12) United States Patent
Miura et al.

(10) Patent No.: US 9,586,256 B2
(45) Date of Patent: Mar. 7, 2017

(54) FORGING METHOD AND FORGING DIE

(71) Applicant: NGK Insulators, Ltd., Nagoya-Shi (JP)

(72) Inventors: Hiromi Miura, Chofu (JP); Naokuni Muramatsu, Nagoya (JP)

(73) Assignees: NGK Insulators, Ltd., Nagoya (JP); The University of Electro-Communications, Chofu-Shi (JP)

( * ) Notice: Subject to any disclaimer, the term of this patent is extended or adjusted under 35 U.S.C. 154(b) by 0 days.

(21) Appl. No.: 14/474,645

(22) Filed: Sep. 2, 2014

(65) Prior Publication Data

US 2014/0366604 A1 Dec. 18, 2014

Related U.S. Application Data

(63) Continuation of application No. PCT/JP2013/057246, filed on Mar. 14, 2013.

(30) Foreign Application Priority Data

Mar. 27, 2012 (JP) ..... 2012-072259

(51) Int. Cl.
*B21J 5/02* (2006.01)
*B21J 13/02* (2006.01)
(Continued)

(52) U.S. Cl.
CPC ..... *B21J 5/02* (2013.01); *B21J 1/006* (2013.01); *B21J 5/025* (2013.01); *B21J 13/02* (2013.01); *B21J 13/14* (2013.01); *C22C 9/00* (2013.01); *C22C 9/06* (2013.01); *C22C 21/10* (2013.01); *C22C 23/02* (2013.01); *C22C 38/00* (2013.01); *C22C 38/18* (2013.01); *C22F 1/08* (2013.01)

(58) Field of Classification Search
CPC ..... B21J 1/006; B21J 5/02; B21J 5/025; B21J 13/02; B21J 13/14; B21J 1/025; B22F 3/12; B22F 3/17
See application file for complete search history.

(56) References Cited

U.S. PATENT DOCUMENTS 4,721,537 A 1/1988 Ghosh
2010/0329923 A1 12/2010 Muramatsu

FOREIGN PATENT DOCUMENTS

CN 1095651 A 11/1994
CN 101981211 A 2/2011
(Continued)

OTHER PUBLICATIONS

International Preliminary Report on Patentability (Application No. PCT/JP2013/057246) dated Oct. 9, 2014.
(Continued)

*Primary Examiner* — Teresa M Ekiert
(74) *Attorney, Agent, or Firm* — Burr & Brown, PLLC

(57) ABSTRACT

A forging method according to the present invention includes the steps of placing a work having a first shape which is a rectangular hexahedron in a work space of a forging die which has a rectangular opening, which is formed by rectangular plane wall portions, and which is provided with the work space to hold the work in a placement step and applying a plastic strain to the work by deforming the placed work into a second shape which is a rectangular hexahedron in a working step, with the placement step and the working step being performed at least two times.

17 Claims, 17 Drawing Sheets

(51) Int. Cl.

| | |
|---|---|
| ***B21J 13/14*** | (2006.01) |
| ***C22C 9/00*** | (2006.01) |
| ***C22C 9/06*** | (2006.01) |
| ***C22C 38/00*** | (2006.01) |
| ***C22C 38/18*** | (2006.01) |
| ***C22F 1/08*** | (2006.01) |
| ***C22C 21/10*** | (2006.01) |
| ***C22C 23/02*** | (2006.01) |
| ***B21J 1/00*** | (2006.01) |

(56) References Cited

FOREIGN PATENT DOCUMENTS

| | | | |
|---|---|---|---|
| EP | 2 264 199 | A1 | 12/2010 |
| JP | 52-68424 UI | | 5/1977 |
| JP | 64-022438 | A1 | 1/1989 |
| JP | 2001-252739 | A1 | 9/2001 |
| JP | 2002-001477 | A1 | 1/2002 |
| JP | 2006-116592 | A1 | 5/2006 |
| JP | 2007-327118 | A1 | 12/2007 |
| JP | 2010-065252 | A1 | 3/2010 |
| WO | 2009/119237 | A1 | 10/2009 |
| WO | 2010/049949 | A1 | 5/2010 |

OTHER PUBLICATIONS

Chinese Office Action (Application No. 201380016353.4) dated May 18, 2015.
International Search Report and Written Opinion (Application No. PCl/JP2013/057246) dated Jun. 25, 2013.
Extended European Search Report (Application No. 13768359.5) dated Feb. 9, 2016.

BEFORE FORGING AFTER FORGING

AFTER FORGING

FORGING METHOD AND FORGING DIE

BACKGROUND OF THE INVENTION

1. Field of the Invention

The present invention relates to a forging method and a forging die.

2. Description of the Related Art

A forging method in which a plastic strain is applied to a rectangular parallelepiped bulk body made from a copper-beryllium alloy through press-deformation from X, Y, and Z axes orthogonal to each other has been proposed previously (refer to, for example, PTL 1). According to this method, a bulk body, in which a uniform hardness is held from the surface to the inside and a working strain is not generated easily, can be provided by application of a plastic strain.

CITATION LIST

Patent Literature

PTL 1: WO 2009/119237

SUMMARY OF THE INVENTION

Technical Problem

However, in this forging method described in PTL 1, a step to induce press-deformation from X, Y, and Z axes is performed repeatedly. Consequently, for example, in the case where the working speed is increased in consideration of the production efficiency, there is an issue that the rectangular parallelepiped shape of the bulk body is deformed during this repetition. As described above, more efficient execution of a forging treatment of a work has been required.

The present invention has been made in consideration of the above-described issue, and it is a main object to provide a forging method and a forging die, with which a forging treatment of a work can be executed more efficiently.

Solution to Problem

That is, a forging method according to the present invention is characterized by including:

a placement step of placing a work having a first shape which is a rectangular hexahedron in a work space of a forging die, the work space having a rectangular opening, being formed by rectangular plane wall portions, and being provided for holding the work; and a working step of applying a plastic strain to the work by deforming the placed work into a second shape which is a rectangular hexahedron, wherein the placement step and the working step are performed at least two times.

In addition, a forging die according to the present invention is a forging die used in a forging method that applies a plastic strain to a work by deforming the work having a first shape which is a rectangular hexahedron into a second work having a second shape which is a rectangular hexahedron, the forging die including an outer die which has a circular opening and which is provided with the inner peripheral surface of the circle and an inner die which has a rectangular opening and in which a work space for holding the above-described work is formed by rectangular plane wall portions, while a plurality of die parts are combined and are fitted into the inner periphery of the above-described outer die.

Advantageous Effects of Invention

According to the present invention, a forging treatment of a work can be executed more efficiently. This is because, for example, the work is press-deformed in the work space of the forging die and, thereby, the shape stability can be further ensured. Also, the forging die has a structure in which a plurality of die parts are fitted into the inner periphery of the outer die, so that, for example, the stress applied to the inner die during pressurization of the work can be dispersed to the outer peripheral side more evenly by the plurality of die parts and breakage of the die and the like can be further suppressed. Consequently, for example, die exchange and the like can be further suppressed and, by extension, the forging treatment of a work can be executed more efficiently.

DETAILED DESCRIPTION OF THE INVENTION

Figure 1:
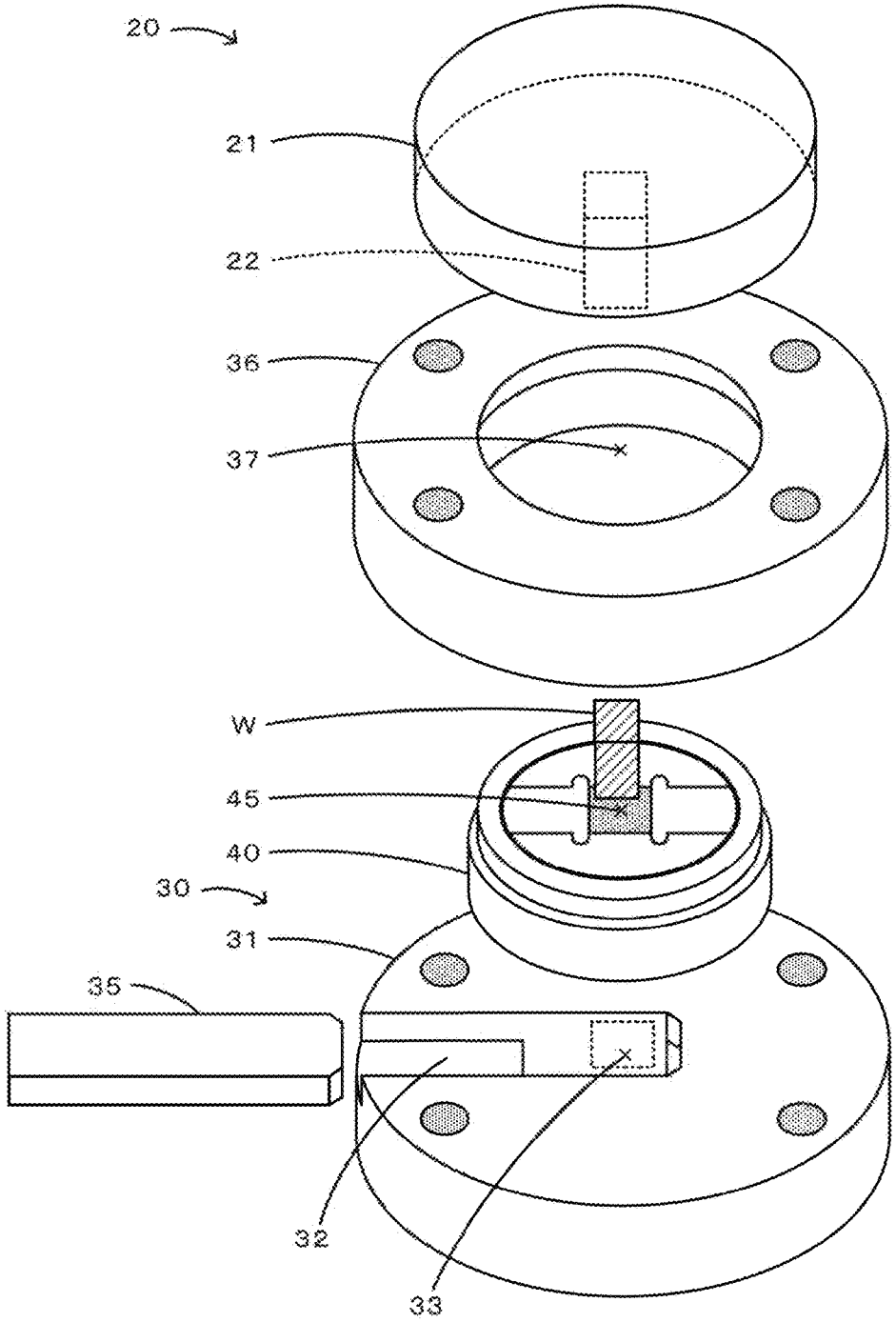
FIG. 1 is an exploded perspective view showing an example of a forging die 20.
Figure 2:
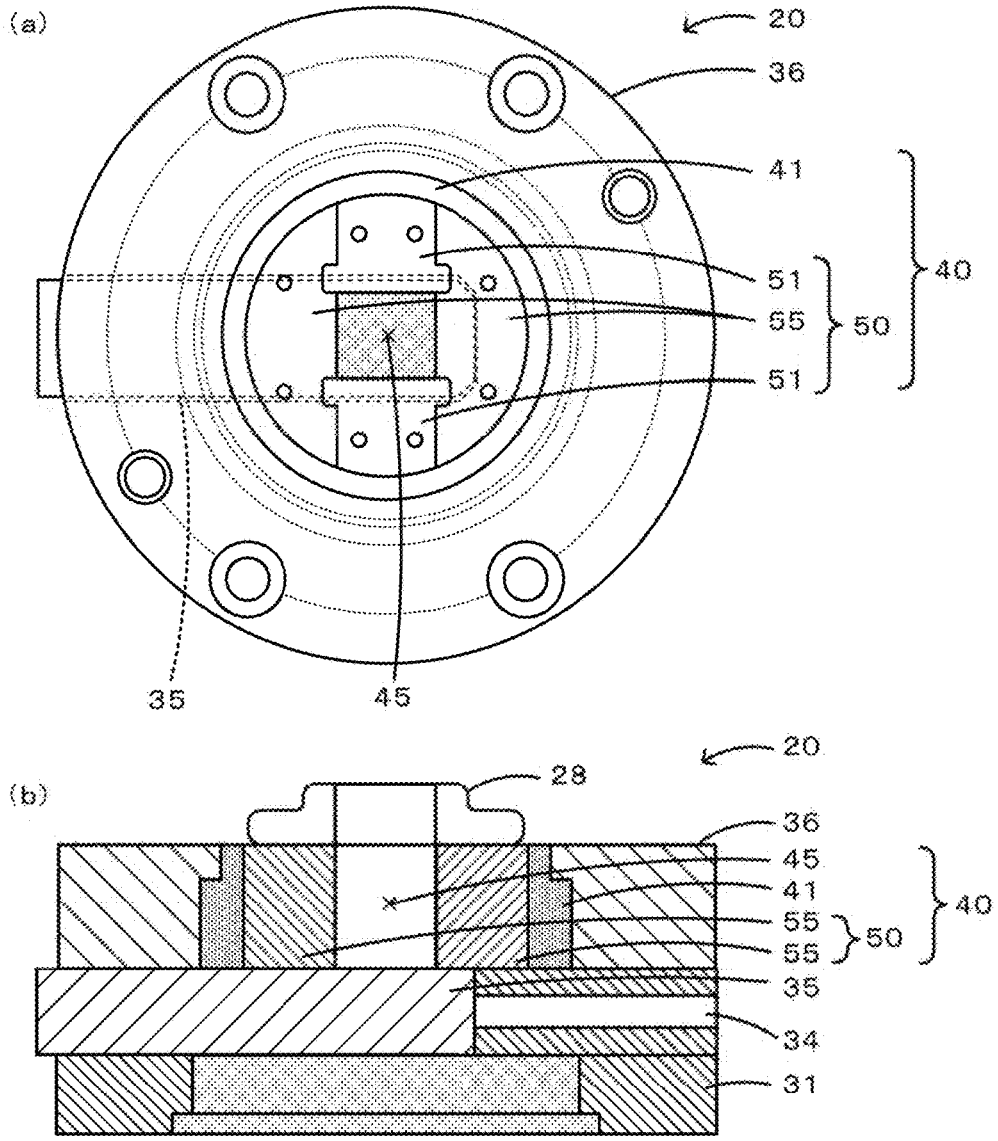
FIG. 2 shows a plan view and a sectional view of the forging die 20.
Figure 3:
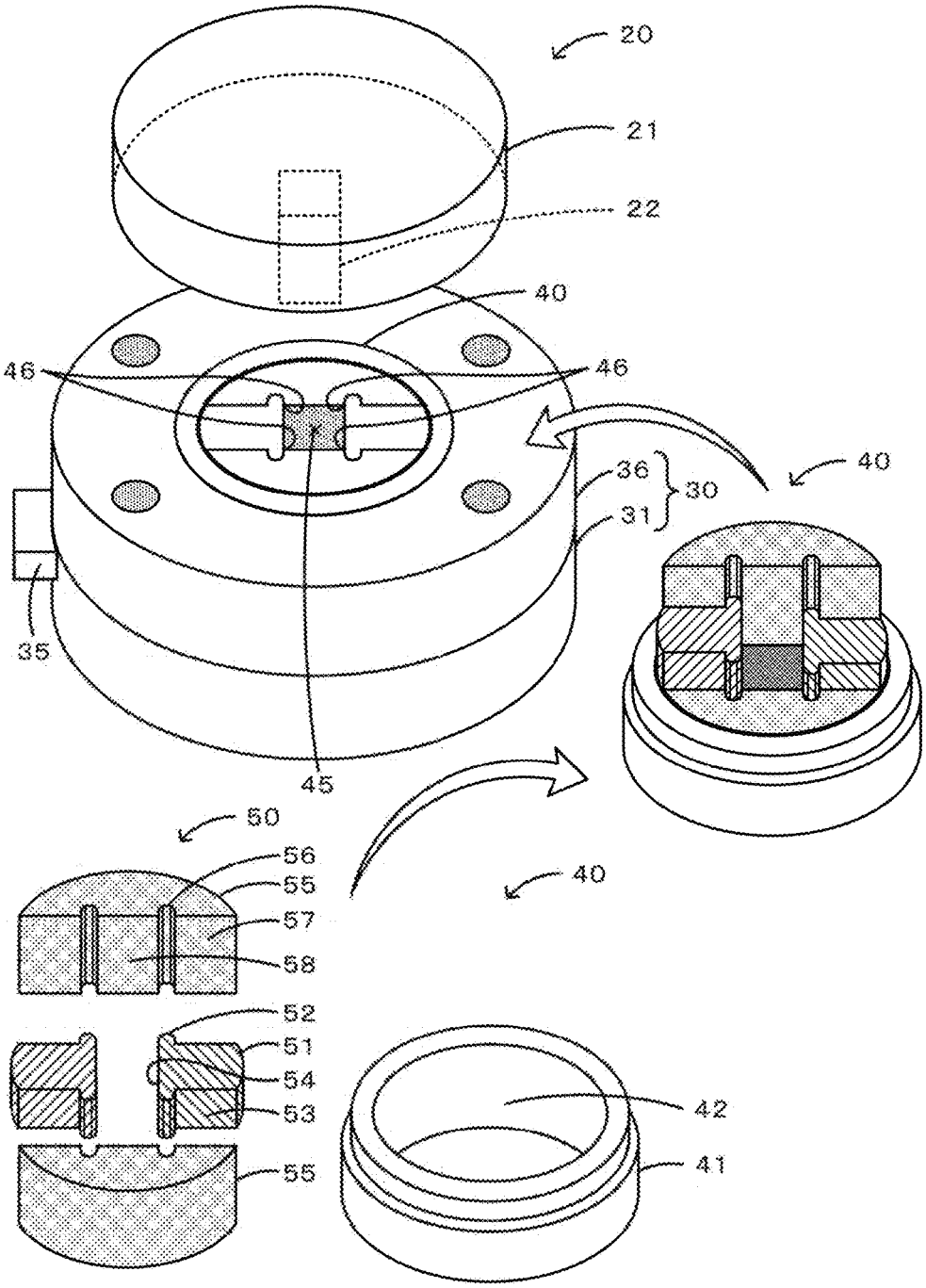
FIG. 3 shows a perspective view of the forging die 20 and an exploded perspective view of a die unit 40.

Next, the embodiments according to the present invention will be described with reference to the drawings. In this regard, in the following description of the drawings, the same or similar portions are indicated by the same or similar reference numerals. Meanwhile, the embodiments described below are exemplifications of apparatuses and methods for embodying the technical idea of the present invention. The technical idea of the present invention does not limit the structures, arrangements, and the like of constituent parts to those described below. To begin with, a forging die 20 used for the forging method according to the present invention will be described. FIG. 1 is an exploded perspective view showing an example of the forging die 20. FIG. 2 shows a plan view and a sectional view of the forging die 20. FIG. 3 shows a perspective view of the forging die 20 and an exploded perspective view of a die unit 40. The forging die 20 is used for a forging method to apply a plastic strain to a work by deforming the work having a first shape which is a rectangular hexahedron into a work having a second shape which is a rectangular hexahedron. As shown in FIGS. 1 and 2, the forging die 20 includes an upper die 21 to press-deform a work W from above and a lower die 30 to hold the work W in a work space 45 which is a rectangular parallelepiped space.

The upper die 21 is a member which is fixed to a slide knock-out beam of a cold forging press machine, although not shown in the drawing, and which is moved in the vertical direction to press the work W placed on the lower die 30 with an upper die indenter 22. This upper die 21 is provided with the upper die indenter 22, which press-deforms the work W, on the lower surface of a disk-shaped member. This upper die indenter 22 is formed into the shape of a prism having an end with a rectangular plane.

An alignment jig 28 is a jig used for aligning the upper die indenter 22 with a work space 45. This alignment jig 28 is used by being placed on the upper portion of a die unit 40.

The lower die 30 is a disk-shaped member and is a member which is fixed to a bottom knock-out beam of the cold forging press machine, although not shown in the drawing. This lower die 30 includes a first lower die 31 serving as a pedestal, a second lower die 36 fixed above the first lower die 31, a slide pedestal 35 which constitutes the bottom of the work space 45 and which is slidable, and the die unit 40 which is provided with the work space 45 and which is fixed in the lower die 30 while being sandwiched between the first lower die 31 and the second lower die 36.

The first lower die 31 is a disk-shaped member, and on the upper surface thereof, a slide groove 32 to slidably insert the tabular slide pedestal 35 is disposed from the center portion to the outer periphery of the disk. Also, a communication space 33 communicating with the work space 45 disposed in the die unit 40 is disposed at the center of the disk. That is, this lower die 30 is configured in such a way that when the slide pedestal 35 is slid, the work space 45 communicates with the communication space 33 and the work space 45 communicates with the outside. Therefore, in the lower die 30, when the slide pedestal 35 is slid, the work W can be moved from the work space 45 to this communication space 33. The slide pedestal 35 is a member which constitutes the bottom of the work space 45 and on which the work W is placed. This slide pedestal 35 has such strength that can endure the pressing force applied to the work W in the forging treatment. The second lower die 36 is a disk-shaped member having the same diameter as the diameter of the first lower die 31, and at the center thereof, a mounting space 37, which has a circular opening and in which the die unit 40 is mounted, is disposed. The first lower die 31 and the second lower die 36 are fixed firmly with bolts, although not shown in the drawing. In this regard, the first lower die 31 is provided with a through hole 34 to allow the communication space 33 to communicate with the outside (refer to FIG. 2).

As shown in FIG. 3, the die unit 40 includes an outer die 41 which has a circular opening portion and which is provided with the inner peripheral surface 42 of this circle and an inner die 50 having a plurality of die parts that are combined and are fitted into the inner periphery of the outer die 41 to form the work space 45. In this die unit 40, the inner die 50 is shrinkage-fitted into the inside of the outer die 41 by setting the inner die 50 on the inner periphery of the heated outer die 41 and performing cooling. The outer die 41 is a ring-shaped member provided with the inner peripheral surface 42, and the inner die 50 is fitted into the inside thereof. The outer die 41 is provided with a height difference on the outer periphery thereof and is fixed in the mounting space 37 by this height difference being caught on the inner periphery of the second lower die 36. The inner die 50 is a member which has a disk-shaped external appearance with a height difference, which includes a plurality of die parts separated from each other at corner portions formed by two planes of the work space 45, and which has the work space 45 with a rectangular opening portion at the center thereof. This inner die 50 is composed of two first die members 51 and two second die members 55. The first die member 51 has a wall portion 54, which is a rectangular plane and which is provided with convex portions 52 at the two ends thereof, on the center side of the inner die 50, and is connected to the second die members 55 with connection surfaces 53 serving as side surfaces. The second die member 55 is provided with two concave portions 56 on the center side thereof. The outsides of the compartment by the concave portions 56 are the connection surfaces 57 to come into contact with the first die members 51, and the inside is a wall portion 58 which is a rectangular plane. In this inner die 50, the convex portions 52 and the concave portions 56 are fitted with each other, a disk-shaped member is thereby produced, and movements of the first die members 51 and the second die members 55 are regulated. Also, in the inner die 50, the work space 45 is formed by the wall portions 54, which are rectangular planes orthogonal to the connection surfaces 53, of the first die members 51 and the wall portions 58, which are rectangular planes parallel to the connection surfaces 57, of the second die members 55. Also, this inner die 50 is configured in such a way that the corner portions 46 of the work space 45 are formed by combining the plurality of first die members 51 and the plurality of second die members 55 at the connection surfaces 53 and the connection surfaces 57.

The work W can be, for example, a copper alloy. As for the work W, besides alloys containing Be and Cu, copper alloys containing Ni, Sn, and Cu, copper alloys containing Ti, Fe, and Cu, copper alloys containing Ni, Si, and Cu, and the like, which exhibit high work hardenability and high strength as with the alloys containing Be and Cu, can be adopted. That is, examples of copper alloys include CuBeCo, CuBeNi, CuNiSn, and CuTiFe, and among them, CuBeCo, CuBeNi, and the like are more preferable. As for these alloys, the forging treatment step according to the present invention can be executed, although temperatures, times, and the like of a homogenization treatment step, a solid solution treatment step, and an age-hardening treatment step may be different depending on the selection ranges of the elements and compositions, as described later in detail. Alternatively, high purity Cu (for example, 4N—Cu) may be employed as the work W. Also, other than copper alloys, for example, magnesium alloys (AZ31; Mg—Al—Zn—Mn base alloys and the like), iron and steel materials (Fe-20Cr, SUS304, and the like), and aluminum alloys (7475Al; Al—Zn—Mg—Cu base alloys and the like) may be employed as the work W.

The thus configured forging die 20 has a structure in which the plurality of die parts are fitted into the inner periphery of the outer die 41. Therefore, for example, the stress applied to the inner die 50 during pressurization of the work W can be dispersed to the outer peripheral side more evenly by the plurality of die parts and breakage of the die and the like can be further suppressed. Also, the inner die 50 is composed of the plurality of die parts separated from each other at corner portions formed by two planes of the work space 45, so that an occurrence of cracking of the die at the corner portion 46 of the work space 45, to which the stress is applied, can be prevented. Furthermore, when the slide pedestal 35 is slid, a space communicating with the outside from the work space 45 is formed and, thereby, the work W after working is taken out of the communication space 33 easily.

Next, the forging method according to the present invention will be described. The forging method according to the present invention can be applied to, for example, a production treatment of a copper-beryllium base alloy. A method for manufacturing a copper-beryllium base alloy will be described below as a specific example. The manufacturing method according to the present invention may include (1) a homogenization treatment step, (2) a solid solution treatment step, (3) a cooling treatment step, (4) a forging treatment step which is the forging method according to the present invention, and (5) an age-hardening treatment step.

(1) Homogenization Treatment Step

In this step, a treatment to generate a copper alloy, in which no dislocation occurs in crystal grains, is performed, wherein a solid solution of Be (or Be compound) in a Cu matrix is formed. Specifically, a copper alloy configured to have a mass ratio of $Cu_{100-(a+b)}Be_aCo_b$ ($0.4\% \le a \le 2.0\%$, $0.15\% \le b \le 2.8\%$, $a+b \le 3.5\%$) or a mass ratio of $Cu_{100-(c+d)}Be_cNi_d$ ($0.05\% \le c \le 0.6\%$, $1.0\% \le d \le 2.4\%$, $c+d \le 3.0\%$) is melted in a high-frequency melting furnace to produce an ingot. At this time, preferably, Fe, S, and P serving as impurities can be limited to less than 0.01% on a mass ratio basis. The resulting ingot is heated and held in a solid solution temperature range (within the range of 700° C. to 1,000° C.) for a predetermined holding time (1 hour to 24 hours) and, thereby, is homogenized because nonuniform textures, e.g., segregation, which are generated in a non-equilibrium manner during casting and which adversely affects the downstream operations, are removed. Subsequently, the resulting ingot is worked into a rectangular parallelepiped copper alloy (bulk body) having a predetermined size. An oxide film formed on the surface of the copper alloy may be removed by cutting. The bulk body may be a rectangular parallelepiped having sides extending in directions of three axes (X, Y, and Z axes) orthogonal to each other. This bulk body is in the shape of a rectangular parallelepiped in which the ratio of lengths of the individual sides (side X, side Y, and side Z) is specified to be x:y:z (where $x<y<z$, $1.03x \le y \le 1.49x$, $1.06x \le z \le 2.22x$, and $z=(y/x)^2x$ are satisfied) preferably (refer to FIG. 5 described later). Also, at this time, the shape of a rectangular parallelepiped satisfying $1.10x \le y \le 1.20x$ and $1.21x \le z \le 1.44x$ is more preferable.

(2) Solid Solution Treatment Step

In this step, a treatment to form a solid solution of Be (or Be compound) in a Cu matrix is performed by heating and holding the bulk body obtained in the homogenization treatment in a solid solution temperature range (within the range of 700° C. to 1,000° C.) for a predetermined solid solution holding time (1 hour to 24 hours). After the solid solution treatment step, an overaging treatment may be performed, wherein the resulting bulk body is held in an overaging temperature range (within the range of 550° C. to 650° C.) for a predetermined time (2 to 6 hours). Consequently, it is considered that precipitated grains of the copper alloy can be grown to the size (for example, an average grain size of about 1 μm) of an extent which does not adversely affect in the individual production steps thereafter. In this regard, the solid solution treatment and the overaging treatment may be performed independently (discontinuously) or be performed continuously. Grains which have been appropriately precipitated by this overaging treatment act favorably and, thereby, an effect of efficiently uniformly deforming up to the inside is obtained. According to this, generation of a shear band texture crossing a plurality of crystal grains is suppressed and cracking, breakage, and the like do not occur, so that a copper-beryllium bulk body can be obtained, where uniform hardness can be held from the surface to the inside, the fatigue life is excellent, and a working strain does not occur easily.

(3) Cooling Treatment Step

In this step, the bulk body subjected to the solid solution treatment is cooled by water cooling, air cooling, or standing to cool in such a way that the surface temperature of the copper alloy becomes, for example, 20° C. or lower. The cooling rate is different depending on the size of the bulk body and is preferably −100° C./s or more (preferably −200° C. or more).

(4) Forging Treatment Step

Figure 4:
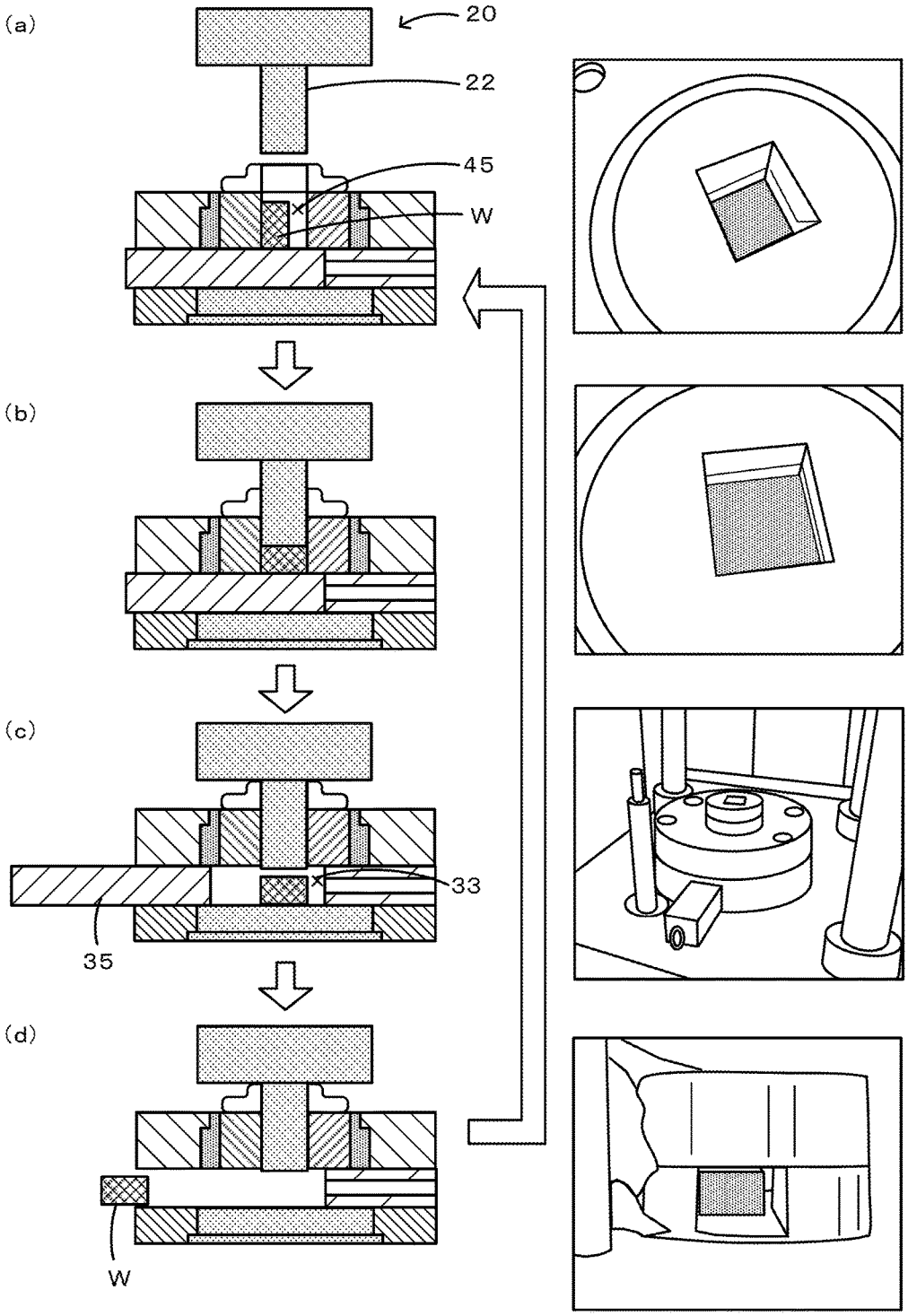
FIG. 4 shows explanatory diagrams illustrating an example of a forging method.
Figure 5:
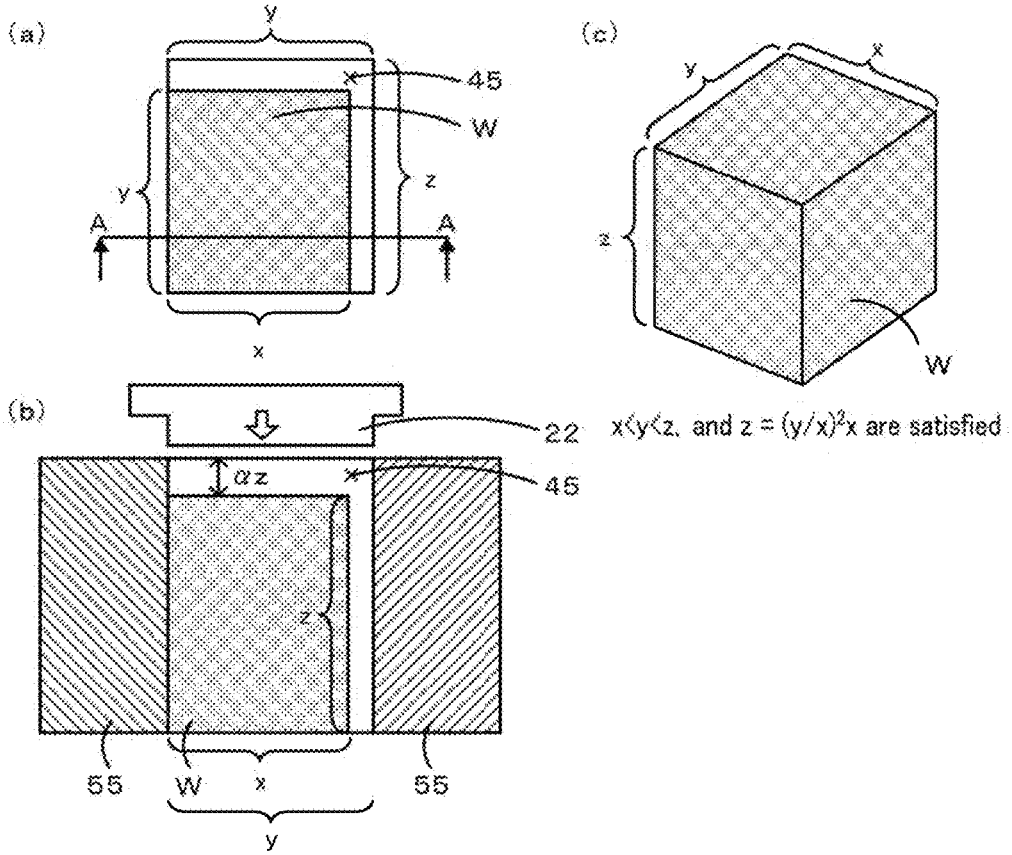
FIG. 5 shows explanatory diagrams of the volume ratio of a work space 45 and a work W.

In this step, the bulk body after cooling is used as a work W and is subjected to a treatment in which forging is performed from the X axis, the Y axis, and the Z axis directions, which are orthogonal to each other, of the rectangular parallelepiped, while cooling and heat removal are performed. The forging treatment step includes, for example, a placement step to place the work W having a first shape, which is a rectangular hexahedron (rectangular parallelepiped), in a work space 45 of a forging die 20 and a working step to apply a plastic strain to the work W by deforming the placed work into a second shape, which is a rectangular hexahedron, wherein the placement step and the working step are performed at least two times. FIG. 4 shows explanatory diagrams illustrating an example of the forging method according to the present invention. FIG. 4 (*a*) is an explanatory diagram of the placement step. FIG. 4 (*b*) is an explanatory diagram of the working step. FIG. 4 (*c*) is an explanatory diagram of a push-out step. FIG. 4 (*d*) is an explanatory diagram of a take-out step. FIG. 5 is an explanatory diagram of changes in work texture by the forging method according to the present invention. In this forging treatment step, a treatment in which the work W is put into the work space 45, is press-deformed, and is taken out by being pushed out is performed repeatedly. In this regard, in the use of the forging die 20, preferably, a lubricant is used on the surface of the work W and the wall portions 54 and 58 constituting the work space 45, and the like. That is, the forging treatment may be performed in such a way that the lubricant is interposed between the work W and the forging die 20. As for the lubricant, for example, gel bodies (metal soap and the like), powders ($MoS_2$, graphite, and the like) and liquids (mineral oil and the like) can be used.

In the placement step (refer to FIG. 4 (*a*)), the work W to be employed satisfies a predetermined relationship of the volume ratio, which is the ratio of the volume of the work space 45 to the volume of the work W. For example, this volume ratio of the work space 45 to the work W is specified to be preferably within the range of 1.20 or more and 3.50 or less, and more preferably within the range of 1.22 or more and 2.20 or less. Also, it is preferable that this volume ratio of the work space 45 to the work W be specified to satisfy $(y/x)\times(z/y)\times z(1+\alpha)/z$; (where $x<y<z$ and $0<\alpha\le 0.5$), when the ratio of lengths of the individual sides (side X, side Y, and side Z) of the work W is specified to be x:y:z and the amount of pressurization corresponds to press-in of the upper die indenter 22 by the amount of (z−x) from the upper surface of the work W. That is, in the case where the work W is specified to be in the shape of a rectangular parallelepiped with the ratio of lengths of the individual sides (side X, side Y, and side Z) is specified to be x:y:z (where $x<y<z$), the work space 45 is preferably specified to be a rectangular parallelepiped with $y:z:z(1+\alpha)$. At this time, preferably, the work W is specified to be a rectangular parallelepiped, where the ratio of lengths of the individual sides (side X, side Y, and side Z), x:y:z, satisfies $1.10x \leq y \leq 1.20x$, $1.21x \leq z \leq 1.44x$, and $z=(y/x)^2x$. In this regard, a may be referred to as a top surface coefficient. Here, the term "press-in by the amount of (z−x)" includes press-in by the amount in which a predetermined amount of margin is added to (z−x). For example, an actual amount of press-in may become smaller than the set value because of the thermal expansion of the material, the rigidity of the whole apparatus, the dimensional tolerance of the die, and the like. Here, press-in of the upper die indenter 22 by the amount of $\{z-x\cdot\beta\}$ from the upper surface of the work W is included. This correction coefficient β is a correction coefficient of the mechanical tolerance, includes a variation value of the amount of press-in due to thermal expansion, a variation value of the rigidity (elastic deformation) of the whole apparatus, and dimensional tolerances of the die and the like, and may be, for example, 1.0±0.05. This value of 0.05 of the correction coefficient β is a value empirically determined as 50 times the expansion coefficient because the thermal expansion coefficient of the steel material is about $12\times10^{-6}$/° C. and an increment of 100° C. causes 0.12% of linear expansion. Also, an actual amount of press-in may become smaller than the set value because of return of elastic deformation (springback) of the work W. For example, the above-described correction coefficient of the work W and the like used for a spring material may be larger than 1.0±0.05 and, therefore, this correction coefficient may be set appropriately in accordance with the material to be used. FIG. 5 shows explanatory diagrams of the volume ratio of the work space 45 and the work W. FIG. 5 (*a*) is a top view of the work space 45 including the work W, FIG. 5 (*b*) is a sectional view of an A-A cross-section, and FIG. 5 (*c*) is a perspective view of the work W. The amount of treatment of one batch can be automatically determined by adopting this volume ratio and the amount of pressurization, and the same ratio of lengths of the individual sides as that before the treatment is reproduced after the treatment, so that the efficiency for repetition increases. Therefore, a plastic strain can be applied to the work W more efficiently because of this combination of the volume ratio and the amount of pressurization. Meanwhile, in the placement step, it is preferable that the work W be placed while being in contact with any two surfaces of the side wall portion of the work space 45. Here, preferably, the work W is placed along the three surfaces of the upper surface of the slide pedestal 35 on which the work W is placed, the wall portion 54, and the wall portion 58. Consequently, positional deviation of the work W in the working step can be suppressed and, therefore, a plastic strain can be applied to the work W more efficiently.

Figure 6:
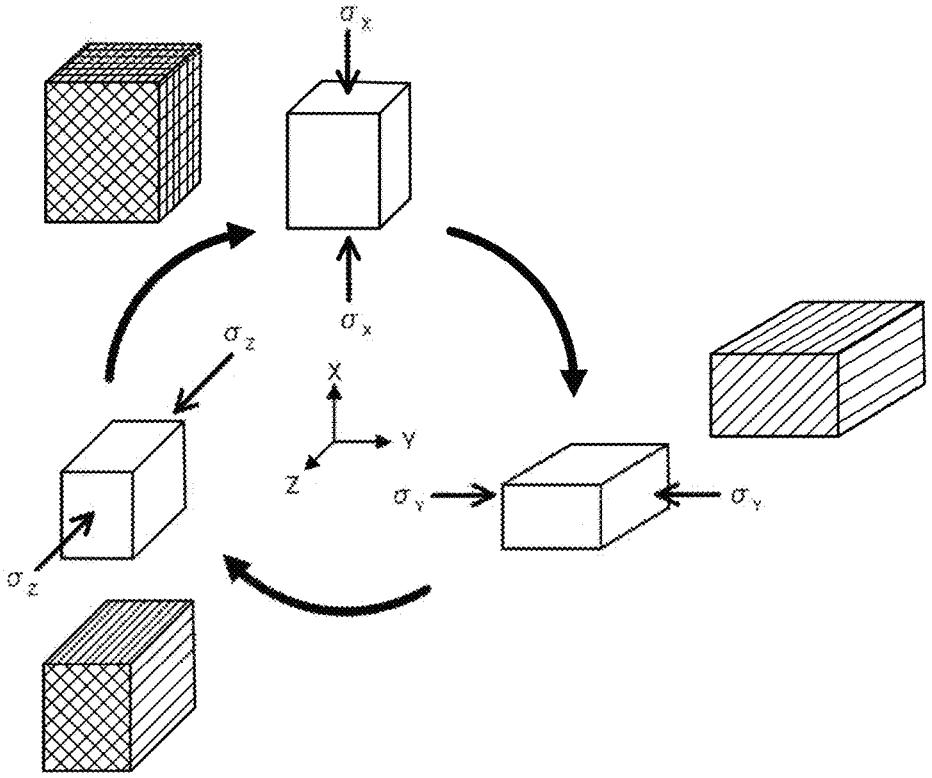
FIG. 6 is an explanatory diagram of changes in work texture depending on a forging method.

In the working step (FIG. 4 (*b*)), the work W is deformed with a sufficient pressing force in the work space 45. In the working step, forging is performed from each of the X axis, the Y axis, and the Z axis directions orthogonal to each other of the rectangular parallelepiped. As for the order of the forging, preferably, the pressure is applied sequentially from the axis direction corresponding to the longest side among the sides included in the work W. For example, the case where the working step is executed in the order of the X axis, the Y axis, and the Z axis as shown in FIG. 6 will be described. In this working step, the surface temperature of the work W in pressurization is kept at, preferably 120° C. or lower (more preferably within the range of 20° C. to 100° C.). If the surface temperature is higher than 120° C., a shear band texture crossing a plurality of crystal grains is generated easily, so that cracking, breakage, and the like occur and, unfavorably, the shape before the working cannot be maintained. The applied pressure is preferably 1,200 MPa or less. In the case where the applied pressure is 1,200 MPa or less, generation of a shear band texture crossing a plurality of crystal grains in the copper alloy can be further suppressed. The amount of reduction (working ratio %) of 1 batch of the working treatment is preferably within the range of 18% or more and less than 33%. Also, the amount of plastic strain (amount of strain; ϵ) applied to the work W is preferably within the range of 0.2 or more and 0.36 or less. In this regard, the term "amount of reduction" refers to a ratio determined by dividing the amount of work deformation by the original height (working ratio) and is expressed as amount of strain $\epsilon=\ln(1-\text{working ratio})$. The strain rate of the plastic strain applied to the work W is preferably within the range of $1\times10^{-3}$ ($s^{-1}$) or more and $1\times10^{+1}$ ($s^{-1}$) or less, and more preferably within the range of $1\times10^{-2}$ ($s^{-1}$) or more and $1\times10^{+1}$ ($s^{-1}$) or less. In this working step, for example, the work W is preferably deformed in such a way that the work W having the first shape before deformation and the work having the second shape after deformation are different in the lengths of the X, Y, and Z axes but the first shape and the second shape are the same shape. That is, the ratio of the individual sides of the work W before deformation and that after deformation are maintained at 1:e:f. Consequently, an equal plastic strain can be given in each axis direction.

In the push-out step (FIG. 4 (*c*)), a treatment is performed, wherein the slide pedestal 35 is slid along the slide groove 32 to form the communication space 33 and, thereafter, the work W in the work space 45 is pushed out to the communication space 33 by being pressurized from above with the upper die indenter 22.

In the take-out step (FIG. 4 (*d*)), a treatment is performed, wherein the work W pushed out is taken out of the communication space 33. For example, the work W is taken out of the space, from which the slide pedestal 35 has been removed, by being pushed with a pushing bar or the like in the through hole 34 (refer to FIG. 2). At this time, it is preferable that the taken out work W be cooled. The cooling method may be any method of air cooling, water cooling, standing to cool, and the like, although the cooling by water cooling is desirable in consideration of the efficiency and the performance of the repeated operation. Preferably, the cooling is performed in such a way that the surface temperature of a hot copper alloy generated from the copper alloy by pressurization becomes 20° C. or lower.

In this forging treatment step, the placement step, the working step, the push-out step, and the take-out step are performed until the predetermined number of times of pressurization is reached. Here, the term "the number of times of pressurization" refers to the number of times counted up, where application of a pressure to the work W from any one of the individual axis (X axis, Y axis, and Z axis) directions is counted as once. Also, the term "the predetermined number of times of pressurization" may refers to the number of times, where a cumulative value of the amount of plastic strain added to the copper alloy (cumulative amount of strain; $\epsilon$ total) becomes, for example, 1.8 or more, and more preferably 4.0 or more.

(5) Age-Hardening Treatment Step

In this step, a treatment is performed, wherein the work W (copper alloy) after the forging treatment is held in a precipitation temperature range (within the range of 200° C. to 550° C.) for a predetermined age-hardening time (1 hour to 24 hours) of a rectangular copper alloy and, thereby, Be (or Be compound) contained in the copper alloy is precipitation-hardened. In this manner, a copper-beryllium alloy having more improved characteristics, e.g., hardness, can be produced.

According to the forging method of the above-described embodiment, the work W is press-deformed in the work space 45 of the forging die 20 and, thereby, the shape stability can be further ensured. Also, the forging die 20 has a structure in which a plurality of die parts are fitted into the inner periphery of the outer die 50, so that, for example, the stress applied to the inner die 50 during pressurization of the work W can be dispersed to the outer peripheral side more evenly by the plurality of die parts and breakage of the die and the like can be further suppressed. Consequently, for example, exchange of the die and the like can be further suppressed and, by extension, the forging treatment of the work can be executed more efficiently. Also, the inner die 50 is composed of the plurality of die parts separated from each other at corner portions 46, so that an occurrence of cracking of the die at the corner portion 46 of the work space 45, to which the stress is applied, can be prevented and, by extension, the forging treatment of the work can be executed more efficiently. In addition, when the slide pedestal 35 is slid, a space communicating with the outside from the work space 45 is formed and, thereby, the work W after working is taken out of the communication space 33 easily. Therefore, the forging treatment of the work can be executed more efficiently. Furthermore, in the placement step, the work is employed preferably in such a way that the volume ratio of the work space 45 to the work W is specified to be within the range of $(y/x)\times(z/y)\times z(1+\alpha)/z$; (where $x<y<z$, $1.10x\leq y\leq 1.20x$ and $1.21x\leq z\leq 1.44x$, $z=(y/x)^2x$, and $0<\alpha\leq 0.5$ are satisfied) and the amount of pressurization corresponds to press-in of the upper die indenter 22 by the amount of $(z-x)$ from the upper surface of the work W. The amount of treatment of one batch can be automatically determined by adopting this volume ratio and the amount of pressurization and the same ratio of lengths of the individual sides as that before the treatment is reproduced after the treatment, so that the efficiency for repetition increases. The forging treatment of the work can be executed more efficiently because of this combination of the volume ratio and the amount of pressurization. Then, in this working step, the work W is deformed in such a way that the work W having the first shape and the work W having the second shape are different in the lengths of the X, Y, and Z axes but the first shape and the second shape are the same shape. Consequently, an equal plastic strain can be added to each axis. Also, in the working step, the work W is deformed at a working ratio within the range of 18% or more and less than 33%, so that the forging treatment of the work can be executed more efficiently. Furthermore, the work W is an alloy containing Be and Cu and, therefore, application of the present invention has great significance. Also, the structure in which the die unit 40 is fitted to the second lower die 36 is employed, so that the die unit 40 can be exchanged easily and the forging treatment of the works W having various types of shapes can be executed more efficiently.

In this regard, the present invention is not specifically limited to the above-described embodiment and can be executed in various aspects within the technical scope of the present invention, as a matter of course. For example, each surface of the bulk body work or the surface of each die in contact with this may be coated with a lubricant. At this time, a lubricant in the form of gel, the form of powder, the form of liquid, or the like can be selected, as necessary. At that time, more preferably, a lubricant which has high thermal conductivity and which does not inhibit heat transfer of working heat from the work W to the inner die is selected.

Figure 7:
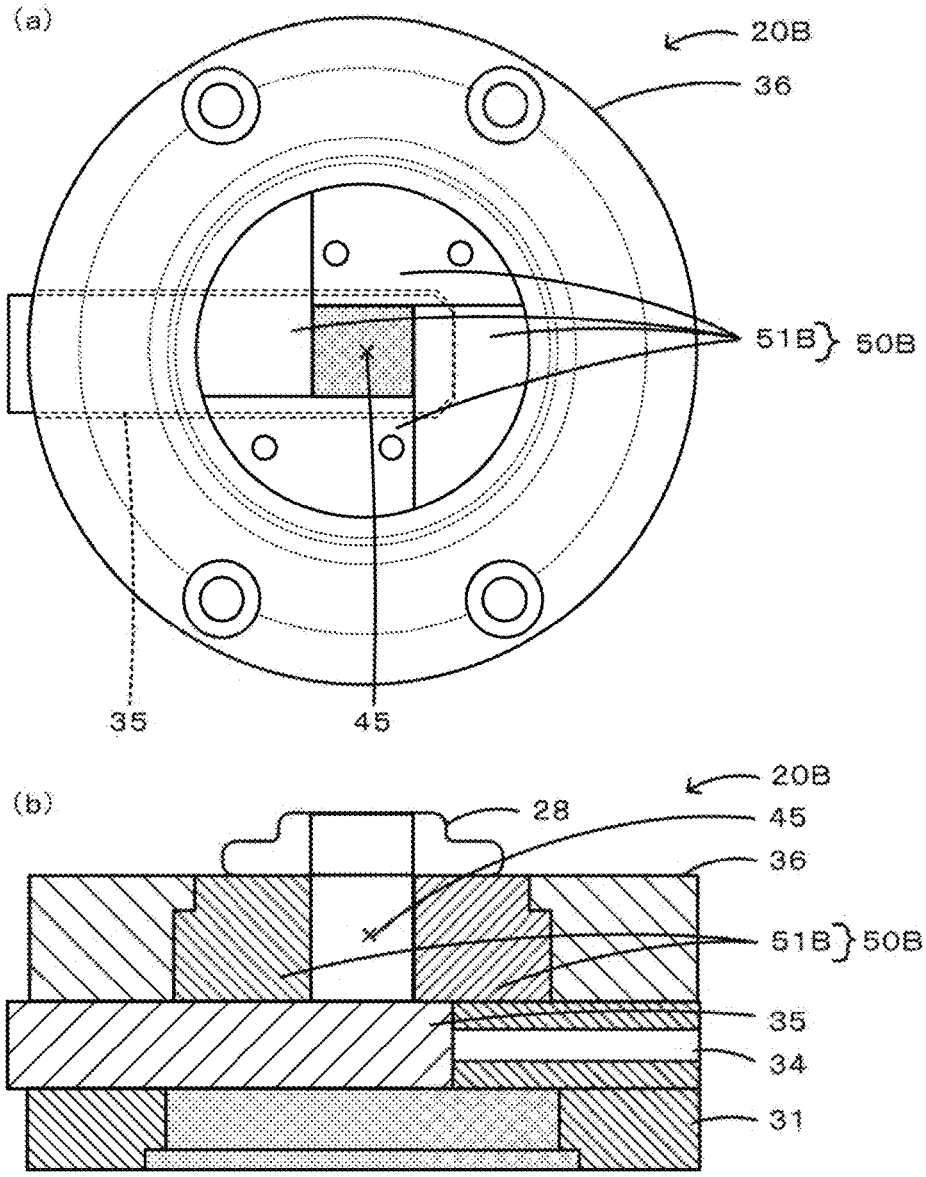
FIG. 7 shows a plan view and a sectional view of a forging die 20B.
Figure 8:
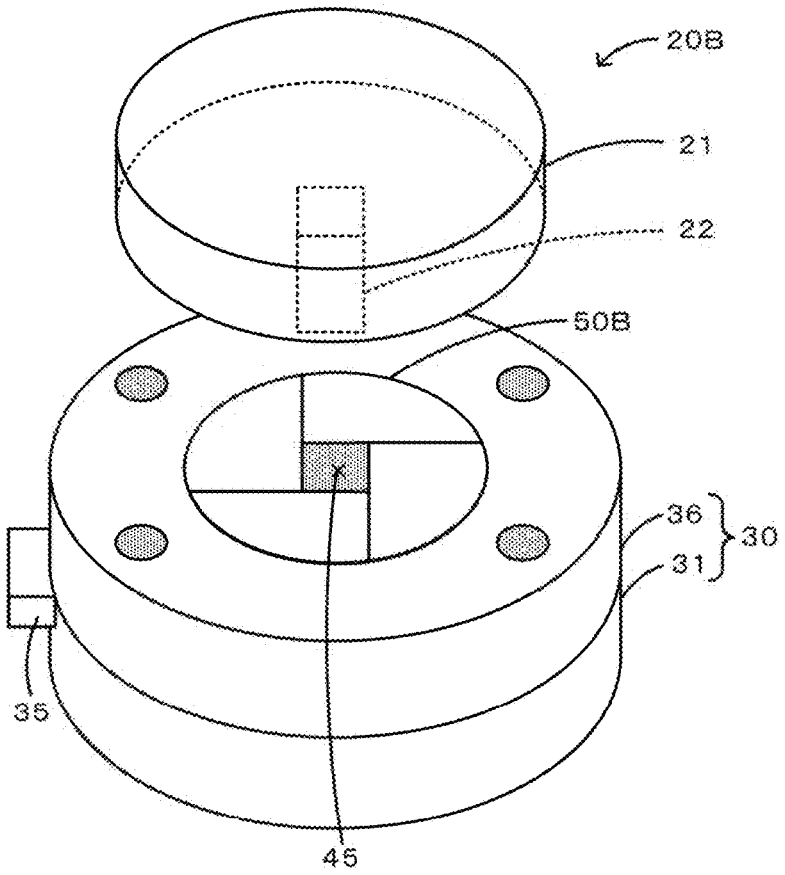
FIG. 8 shows a perspective view of the forging die 20B.

For example, in the above-described embodiment, the forging die 20 including the plurality of die parts provided with the convex portions 52 and the concave portions 56 are used, although not specifically limited to this. A forging die 20B shown in FIGS. 7 and 8 may be used. FIG. 7 shows a plan view and a sectional view of the forging die 20B. FIG. 8 shows a perspective view of the forging die 20B. The forging die 20B includes an inner die 50B which is a combination of four die members 51B having the same shape. Meanwhile, in this forging die 20B, the outer die 41 is not provided and the second lower die 36 is configured to correspond to the outer die according to the present invention. According to this as well, the stress applied to the inner die 50B during pressurization of the work W can be dispersed to the outer peripheral side more evenly by the plurality of die parts 51B, breakage of the die and the like can be further suppressed and, by extension, the forging treatment of the work can be executed more efficiently. In this regard, the convex portions 52 and the concave portions 56 may be disposed at any position of the die members 51B.

Figure 9:
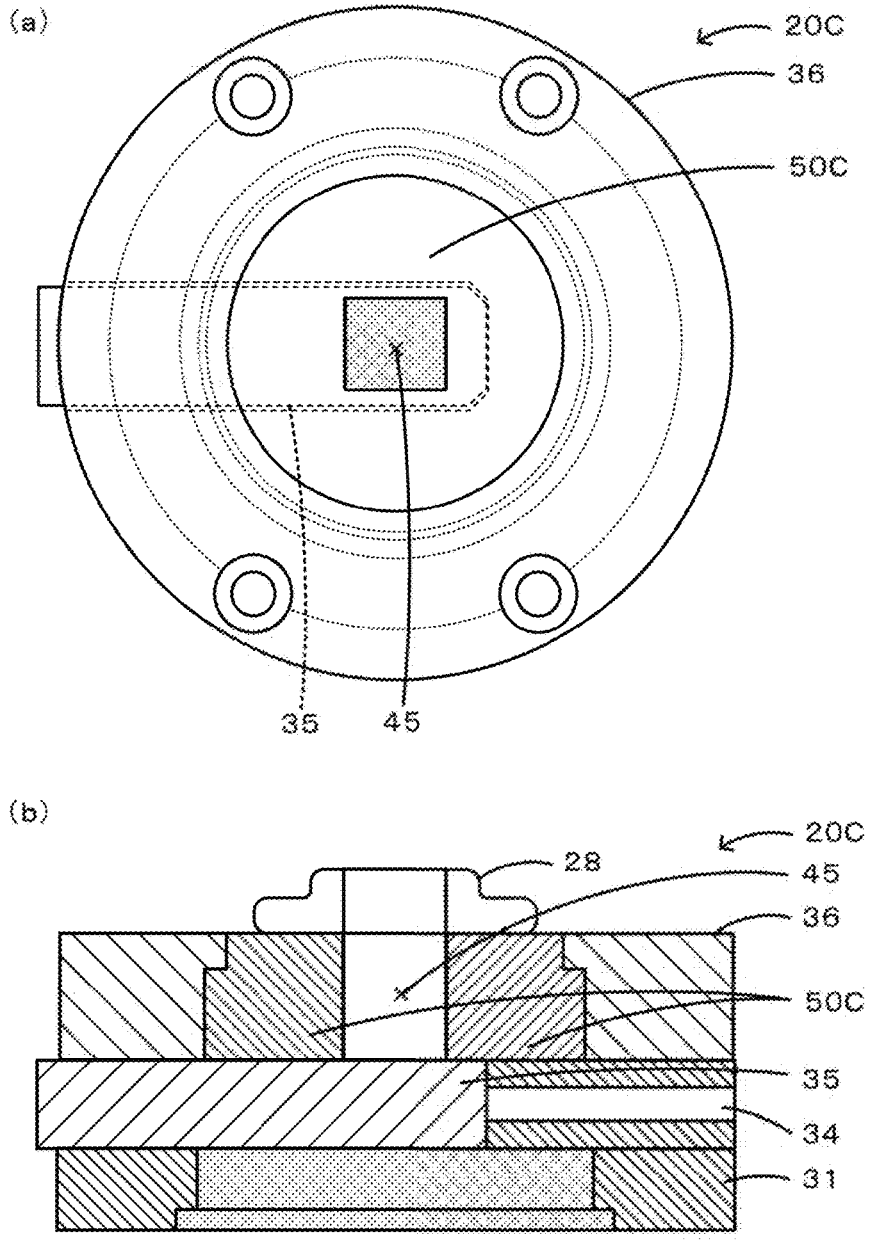
FIG. 9 shows a plan view and a sectional view of a forging die 20C.
Figure 10:
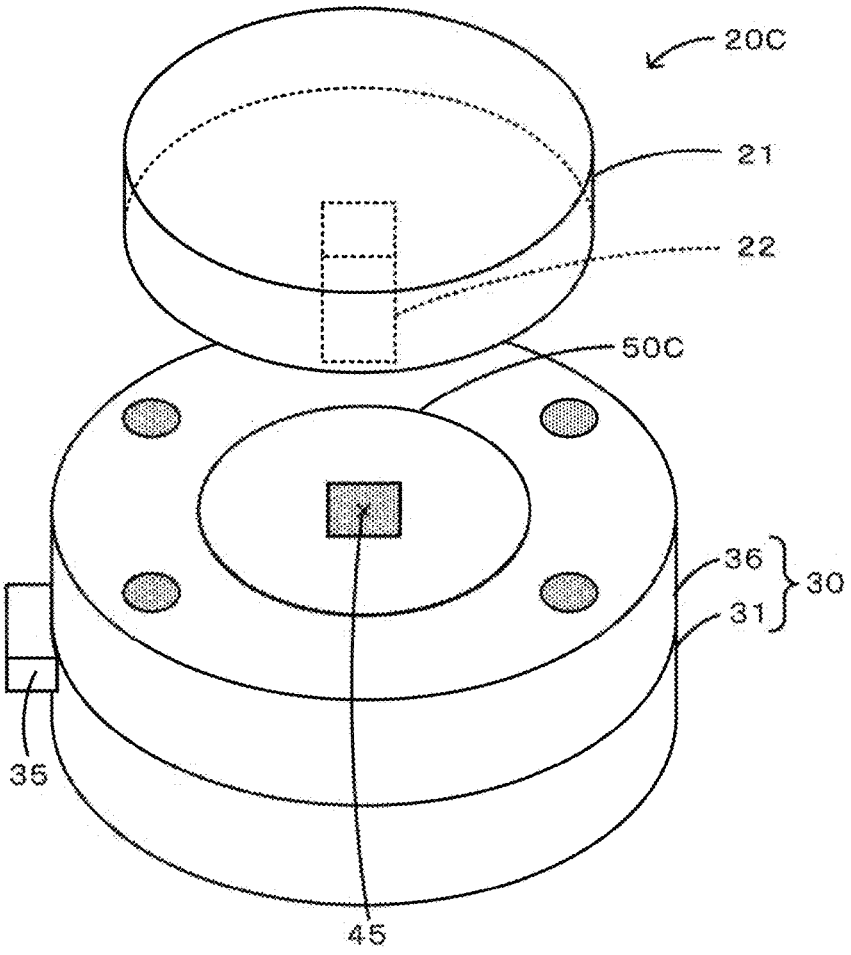
FIG. 10 shows a perspective view of the forging die 20C.

In the above-described embodiment, the forging die 20 including the inner die 50 composed of the plurality of die parts is used, although not specifically limited to this. Alternatively, a forging die 20C shown in FIGS. 9 and 10 may be used. FIG. 9 shows a plan view and a sectional view of the forging die 20C. FIG. 10 shows a perspective view of the forging die 20C. The forging die 20C is not provided with the outer die 41, and includes an inner die 50C not divided. According to this as well, the shape stability can be further ensured and, by extension, the forging treatment of the work can be executed more efficiently because the forging die 20C is used and the work W is press-deformed in the work space 45 having the shape of a rectangular parallelepiped.

In the above-described embodiment, the inner die 50 in which the work space 45 is formed while the plurality of die parts are fitted into the inner periphery of the outer die 41 is included, although not specifically limited to this. The plurality of die parts may be incorporated into the inside of the outer die rather than the circumference. Also, the plurality of die parts separated from each other at the corner portions 46 are included in the above-described embodiment. However, the die parts may be separated from each other at the corner portions 46 or be separated from each other at portions other than the corner portions 46.

In the above-described embodiment, the lower die 30 is formed from the first lower die 31, the die unit 40, the slide pedestal 35, and the second lower die 36, although not specifically limited to this. Other members may be added or at least any one of them may be omitted. For example, in the above-described embodiment, the slide pedestal 35 is included, although the slide pedestal 35 may not be included.

In the above-described embodiment, in the forging treatment step, the work W is cooled after being taken out, although not specifically limited to this. As shown in FIG.

Figure 11:
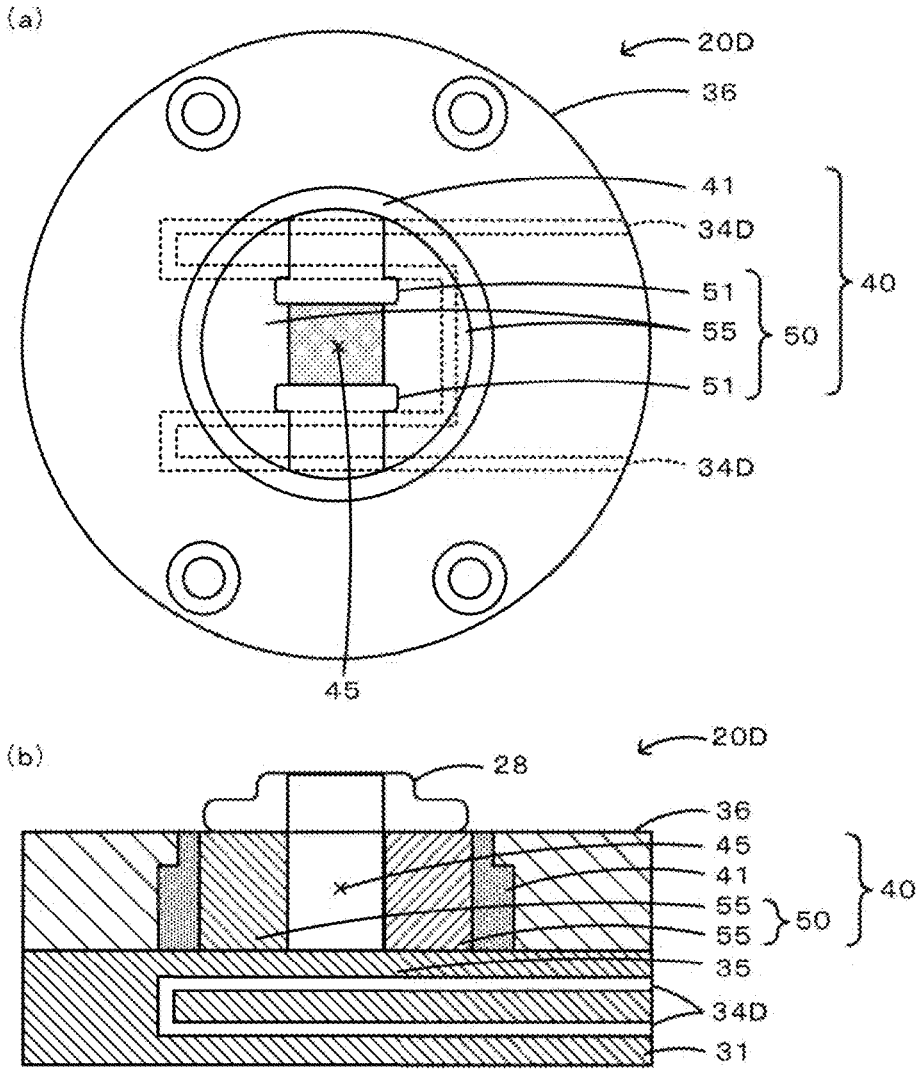
FIG. 11 shows a plan view and a sectional view of a forging die 20D.

11, a forging die 20D may be used and the work W may be cooled during the forging treatment. FIG. 11 shows a plan view and a sectional view of the forging die 20D. This forging die 20D includes a first lower die 31 (base portion) constituting the bottom of the work space 45, and the first lower die 31 is provided with a flow path 34D, through which a cooling medium passes, in the vicinity of the work space 45. A temperature increase may occur during work-deformation of the work W. However, according to this, the work W is cooled and the breakage and the like thereof can be further suppressed and, by extension, the forging treatment of the work can be executed more efficiently.

Figure 12:
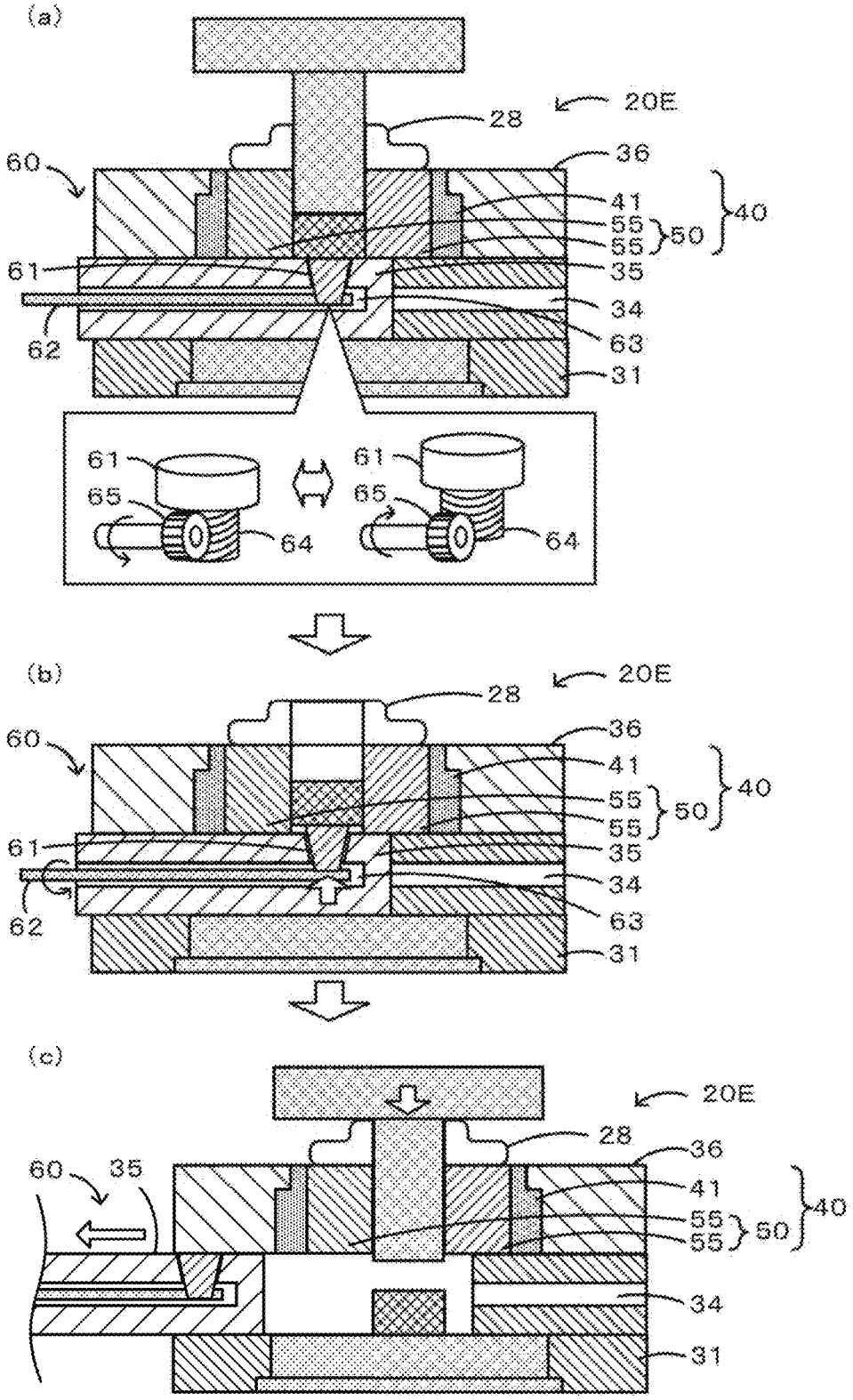
FIG. 12 shows explanatory diagrams of a forging die 20E provided with a lift mechanism 60.
Figure 13:
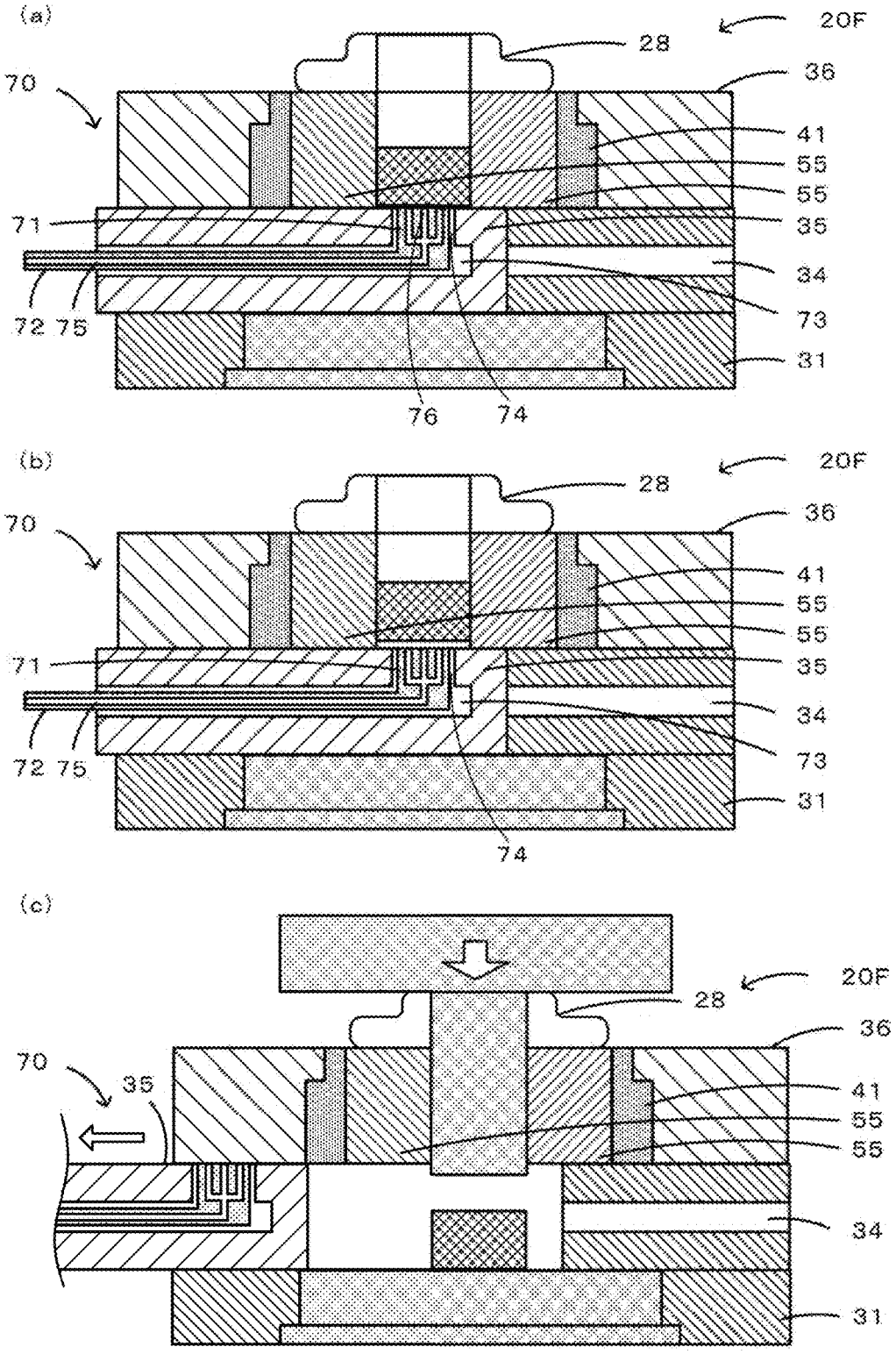
FIG. 13 shows explanatory diagrams of a forging die 20F provided with a lift mechanism 70.

Although an explanation is not specifically provided in the above-described embodiment, as shown in FIGS. 12 and 13, the forging die may include a base portion constituting the bottom of the work space, a lift mechanism which is disposed in the base portion and which lifts the work by pushing the bottom of the work sandwiched in the work space. At this time, the lift mechanism may be disposed in the slide pedestal 35 serving as the base portion. FIG. 12 shows explanatory diagrams of a forging die 20E provided with a lift mechanism 60. FIG. 12 (*a*) corresponds to FIG. 4 (*b*) after the working step. FIG. 12 (*b*) is an explanatory diagram illustrating lifting of the work W. FIG. 12 (*c*) is an explanatory diagram illustrating push-out of the work W. This lift mechanism 60 is disposed in the slide pedestal 35 and is provided with a lifting member 61 to push the bottom of the work W and an operation bar 62 to operate movement of the lifting member 61. An operation space 63, into which the operation bar 62 is inserted, is disposed in the slide pedestal 35. The slide pedestal 35 is provided with a truncated cone shaped-opening portion, in which the upper surface side opening area is larger, is disposed in the region constituting the work space 45. The operation space 63 communicating with this opening portion is disposed in the slide direction of the slide pedestal 35. This operation space 63 is disposed communicating from the outside of the slide pedestal 35 to below the lifting member 61. The lifting member 61 is formed to be fitted into the above-described truncated cone shaped-opening portion in such a way that the upper surface thereof constitutes part of the upper surface of the slide pedestal 35. A rack 64 is disposed under this lifting member 61. The operation bar 62 is formed to have a length enough for being inserted into the operation space 63 and reaching below the lifting member 61, and a pinion 65 is disposed at the end thereof. As for the lift mechanism 60, the lifting member 61 is moved vertically by rotating this pinion 65 while the pinion 65 is engaged in the rack 64 (refer to a balloon shown in FIG. 12 (*a*)). The operator uses this forging die 20E, performs the working step to press-form the work W (FIG. 12 (*a*)) and, thereafter, moves the lifting member 61 vertically by operating the operation bar 62 (FIG. 12 (*b*)). For example, when the working step shown in FIG. 4 (*b*) is performed, the work W may adhere to the slide pedestal 35, and the work W may not be taken out easily. Here, the lift mechanism 60 is provided, and the work W can be pushed upward slightly by vertical movement of the lifting member 61. Consequently, the work W which has adhered to the slide pedestal 35 is detached, so that the push-out step to remove the slide pedestal 35 and take out the work W from the communication space 33 can be performed smoothly (FIG. 12 (*c*)). In this regard, the lift mechanism 60 is not limited to have the configuration of the above-described rack and pinion insofar as the configuration allows the lifting member 61 to move vertically. For example, the lifting member 61 may be pushed up by a movement direction conversion apparatus, e.g., a bevel gear or a worm wheel, or furthermore, a vertical movement mechanism on the basis of a hydraulic pressure. Also, in FIG. 12, a mechanism in which a fulcrum is disposed at nearly end of the operation bar 62 and nearly under the lifting member 61 and the lifting member 61 is pushed up by using the operation bar on the basis of the action of a lever may be adopted. According to this as well, the work W which has adhered to the slide pedestal 35 is detached, so that the push-out step to remove the slide pedestal 35 and take out the work W from the communication space 33 can be performed smoothly.

Alternatively, as shown in FIG. 13, the work W may be lifted from the slide pedestal 35 by ejecting compressed air or a compressed gas to the lower surface of the work W. FIG. 13 shows explanatory diagrams of a forging die 20F provided with a lift mechanism 70. FIG. 13 (*a*) corresponds to FIG. 4 (*b*) after the working step. FIG. 13 (*b*) is an explanatory diagram illustrating lifting of the work W. FIG. 13 (*c*) is an explanatory diagram illustrating push-out of the work W. This lift mechanism 70 is disposed in the slide pedestal 35 and is provided with a lifting member 71 which includes a plurality of ejection holes 76 and which push the bottom of the work W with a fluid (for example, gas or liquid) and a flow tube 72 which is connected to the lifting member 71 and which includes a flow channel 75 to feed the fluid to the ejection holes 76. Also, the slide pedestal 35 is provided with an operation space 73 into which the flow tube 72 is inserted. A circular columnar opening portion is disposed in the upper surface of the slide pedestal 35 constituting the work space 45, and the operation space 73 communicating with this opening portion is disposed in the slide direction of the slide pedestal 35. This operation space 73 is disposed communicating from the outside of the slide pedestal 35 to below the lifting member 71. The lifting member 71 is formed to be inserted into the above-described opening portion in such a way that the upper surface thereof constitutes part of the upper surface of the slide pedestal 35. Also a relief space 74 to discharge the fluid supplied from the flow channel 75 is disposed between the opening portion of the slide pedestal 35 and the lifting member 71. The flow tube 72 is inserted into the operation space 73 and is connected to below the lifting member 71. In the lift mechanism 70, from the flow channel 75 to the ejection holes 76 are in communication with each other, and when a compressed gas serving as a fluid is supplied from the flow channel 75, this compressed gas from the ejection holes 76 of the lifting member 71 pushes the bottom of the work W. The operator uses this forging die 20F, performs the working step to press-form the work W (FIG. 13 (*a*)) and, thereafter, ejects the compressed gas from the ejection holes 76 of the lifting member 71 by supplying the compressed gas from the flow tube 72 (FIG. 13 (*b*)). Consequently, the work W can be pushed upward slightly by the compressed gas from the lifting member 71. In this regard, the gas ejected from the ejection holes 76 is passed through the relief space 74 and are discharged from operation space 73 to the outside. In this manner, the work W which has adhered to the slide pedestal 35 is detached, so that the push-out step to remove the slide pedestal 35 and take out the work W from the communication space 33 can be performed smoothly (FIG. 13 (*c*)). In this regard, the lift mechanisms 60 and 70 may be disposed in the first lower die 31 (base portion) insofar as the bottom of the work W can be pushed. Also, as for the lift mechanisms 60 and 70, configurations other than those described above can be adopted insofar as the mechanism can separate the slide pedestal 35 and the work W.

In the explanations of the above-described embodiments, the work W is an alloy containing Be and Cu. However, the above-described steps may be executed while the work W is specified to be a copper alloy containing Ni, Sn, and Cu, a copper alloy containing Ti, Fe, and Cu, a copper alloy containing Ni, Si, and Cu, or the like, which exhibits high work hardenability and high strength as with the alloy containing Be and Cu. In the case where this alloy is used, the above-described forging treatment steps can be executed, although temperatures and times of the homogenization treatment step, the solid solution treatment step, and the age-hardening treatment step may be different from those in the case of the alloy containing Be and Cu depending on the selection ranges of the elements and compositions. Alternatively, the above-described steps may be executed, where high purity Cu (for example, 4N—Cu) is employed as the work W. Also, in the case of application to those other than the copper alloys, when magnesium alloys (AZ31; Mg—Al—Zn—Mn base alloys and the like) and iron and steel materials (Fe-20Cr, SUS304, and the like) are used, the volume ratio of the work space 45 to the work W may be within the range of $(y/x)\times(z/y)\times z(1+\alpha)/z$; (where $x<y<z$, $1.22x\leq y\leq 1.49x$, $1.49x\leq z\leq 2.22x$, $z=(y/x)^2x$, and $0<\alpha\leq 0.5$ are satisfied) in the above-described forging treatment step. Furthermore, as for aluminum alloys (7475Al; Al—Zn—Mg—Cu base alloys and the like), the volume ratio of the work space 45 to the work W may be within the range of $(y/x)\times(z/y)\times z(1+\alpha)/z$; (where $x<y<z$, $1.03x\leq y\leq 1.06x$, $1.06x\leq z\leq 1.12x$, $z=(y/x)^2x$, and $0<\alpha\leq 0.5$ are satisfied). In this regard, in the case where these alloys are used, in the working step, the work may be deformed at the working ratio within the range of 6% or more and less than 55%.

EXAMPLES

Examples of specific studies of the forging treatment step by using the forging die 20 will be described below. In this regard, Examples 1 to 13 and 23 to 32 correspond to examples according to the present invention and Examples 14 to 22 correspond to comparative examples.

A copper alloy configured to have a mass ratio of $Cu_{100-(a+b)}Be_aCo_b$ (a=1.8% and b=0.2%) and a copper alloy configured to have a mass ratio of $Cu_{100-(c+d)}Be_cNi_d$ (C=0.2% and d=1.8%) were prepared as bulk bodies. In the homogenization treatment step, the treatment was performed at 840° C. for 4 h and working was performed into the shape of 60 mm×66 mm×73 mm (1:1.1:1.21). In the solid solution treatment step, the treatment was performed at 800° C. for 1 h, quenching was performed at about 50° C./s, and the resulting bulk body was taken as a work W. The forging treatment step was performed under the condition in which the volume ratio of the work space 45 to the work W was $(66/60)\times(73/66)\times\{(73/66)+0.5\ \text{mm}\}=1.1\times1.1\times1.6=1.936$, the working ratio was 18% (the amount of strain per batch 0.2), the $\Sigma\epsilon$ strain rate was about $1\times10^0$ ($s^{-1}$), the total amount of strain Fe was 2.4, and the predetermined number of times of pressurization was 12. Here, initially, hardening through forging was examined. The Cu—Be—Co base copper alloy was subjected to a forging treatment with the forging die 20. The resulting work W was taken as Example 1, and the alloy which was not subjected to forging was taken as Comparative example 1. Also, the Cu—Be—Ni base copper alloy was subjected to a forging treatment with the forging die 20. The resulting work W was taken as Example 2, and the alloy which was not subjected to forging was taken as Comparative example 2. As for the lubricant, a SEALUB product produced by NOK KLÜBEL CO. LTD. was applied.

Figure 14:
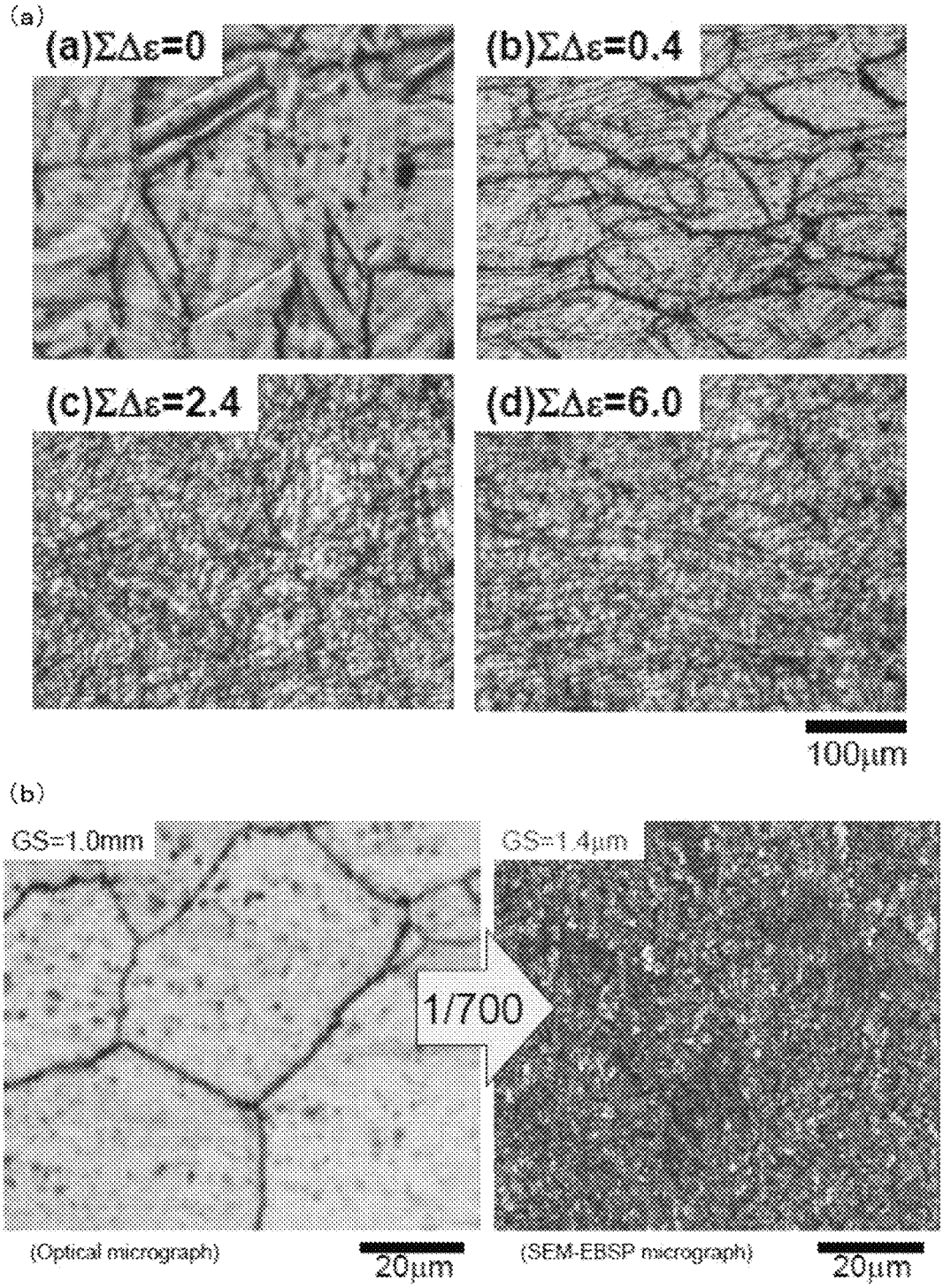
FIG. 14 shows magnified photographs of textures of copper alloy bulk bodies.

FIG. 14 shows magnified photographs of textures of Example 1. FIG. 14 (*a*) shows electron microscope (SEM) photographs. It was found that as the total amount of strain $\Sigma\epsilon$ increased, the texture of the copper alloy became finer. Also, FIG. 14 (*b*) shows texture observation photographs with an optical microscope (Comparative example 1) and SEM (Example 1). It was found that the texture of the copper alloy of Example 1 forged by using the forging die 20 was finer than the texture of Comparative example 1 not subjected to the forging treatment. In this regard, the same results were obtained as for Example 2 and Comparative example 2.

Figure 15:
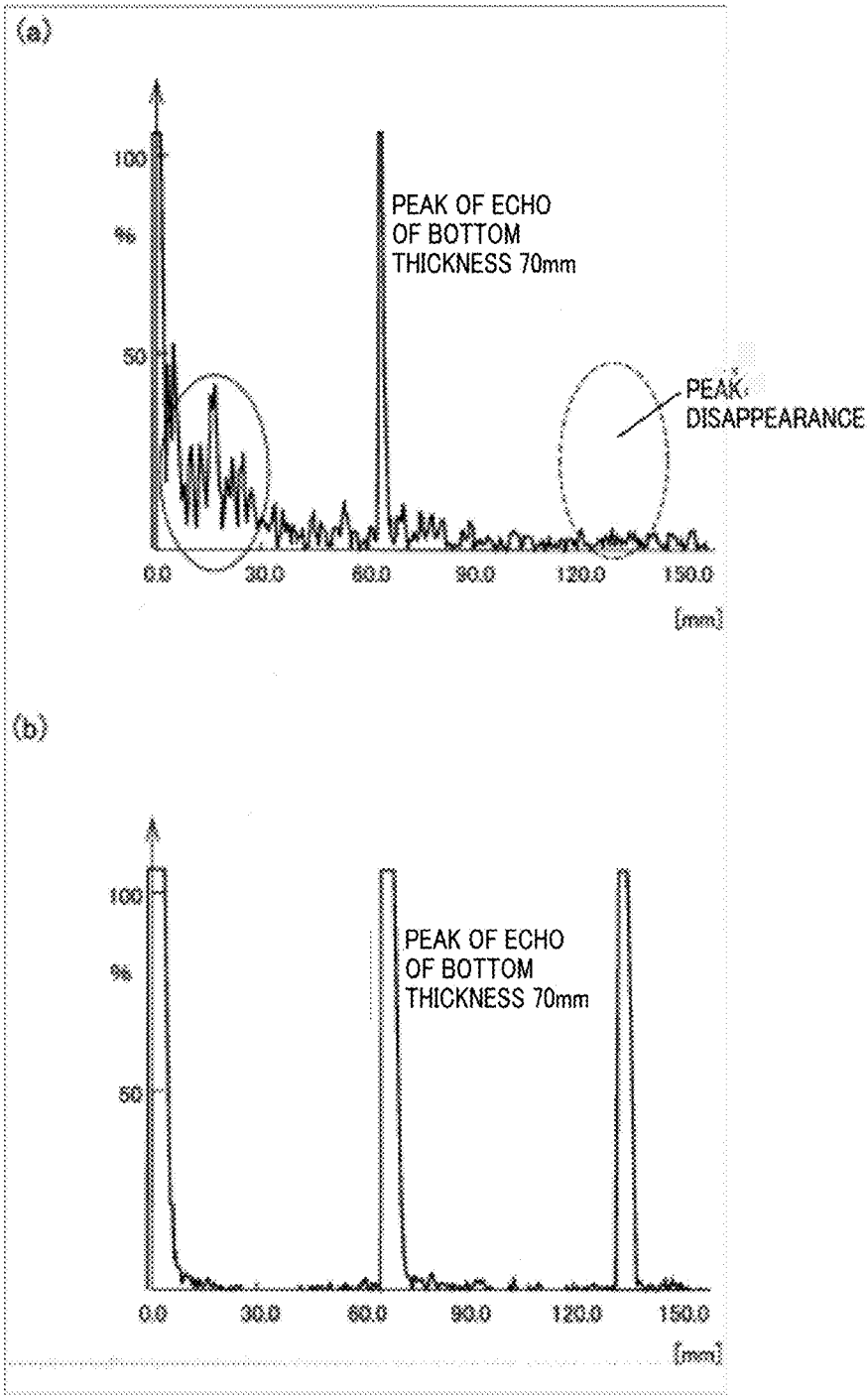
FIG. 15 shows measurement results of ultrasonic flow detection test of copper alloy bulk bodies.

FIG. 15 shows measurement results of ultrasonic flaw detection test of copper alloy bulk bodies. FIG. 15 (*a*) shows the measurement result of a bulk body before forging (Comparative example 1) and FIG. 15 (*b*) shows the measurement result of a bulk body after forging (Example 1). In this measurement, the bulk body in the shape of a 100 mm cube was worked into a 70 mm cube by cutting the surface layer and, thereafter, an ultrasonic wave was transmitted to this bulk body. As shown in FIG. 15 (*a*), in the case where the bulk body was not subjected to the forging treatment, a peak of an echo of the bottom having a thickness of 70 mm appeared, but a peak of an echo due to multiple reflection did not appear (peak disappearance) in the vicinity of the thickness of 140 mm. This indicates that the internal texture of the bulk body was coarse and nonuniform. Also, as shown in FIG. 15 (*a*), there are many noises in the waveform and, therefore, it is estimated that the internal texture of the bulk body was coarse and nonuniform. On the other hand, as is clear from FIG. 15 (*b*), in the case where the bulk body of the example was tested, a peak of an echo of the bottom having a thickness of 70 mm appeared and, in addition, a peak of an echo due to multiple reflection appeared in the vicinity of the thickness of 140 mm. This indicates that the ultrasonic wave was not disturbed or attenuated by the internal texture of the beryllium-copper forged bulk body. It is estimated that the internal texture became denser and more uniform as compared with the case shown in FIG. 15 (*a*) because noises did not appear in the whole waveform.

Experimental Examples 1 to 22

Next, the forging treatment by using the forging die 20 was studied. The shape, the volume ratio, the working ratio, and the like of the work were changed as shown in Tables 1 and 2, and the shapes before and after the forging, the linearity, the maximum dimensional difference, and the like were evaluated on the basis of the appearance thereof. A copper alloy configured to have a mass ratio of $Cu_{100-(a+b)}Be_aCo_b$ (a=1.8% and b=0.2%) and a copper alloy configured to have a mass ratio of $Cu_{100-(c+d)}Be_cNi_d$ (c=0.2% and d=1.8%) were prepared in the same steps as those described above. In this regard, in Table 1, each of a short side x, a middle side y, and a long side z is indicated by a normalized length, where the short length x is specified to be 1.

Experimental Examples 23 to 32

Also, a copper alloy configured to have a mass ratio of $Cu_{97.85}Be_{0.35}Ni_{1.8}$, a copper alloy configured to have a mass ratio of $Cu_{78}Ni_{15}Sn_7$, a copper alloy configured to have a mass ratio of $Cu_{96.9}Ti_3Fe_{0.1}$, a copper alloy configured to have a mass ratio of $Cu_{89}Ni_9Si_2$, a magnesium alloy (AZ31), a steel configured to have a mass ratio of $Fe_{89}CR_{20}$, SUS304, an aluminum alloy (7475Al), and the like were prepared and examined.

Shape Evaluation

As for the shape evaluation, presence or absence of crack, roundness of corner, and the like were examined visually, and the alloy having a good shape was evaluated as ○, and that includes crack or rounded corner was evaluated as x. Also, as for the linearity, whether each of six surfaces keeps flatness or not was examined by visually checking presence or absence of a gap when a ruler is placed on the surface, the case where there was no gap was evaluated as ○, and the case where there was a gap was evaluated as x. Also, as for the maximum dimensional difference, the maximum value of difference in the dimension (length) of each side between before and after the forging was measured, the case where the maximum dimensional difference was 2% or less was evaluated as ○, and the case where the maximum dimensional difference was more than 2% was evaluated as x. In this regard, Tables 1 and 2 show the results of the Cu—Be—Co alloy, and the same results were obtained with respect to the Cu—Be—Ni alloy.

Figure 16:
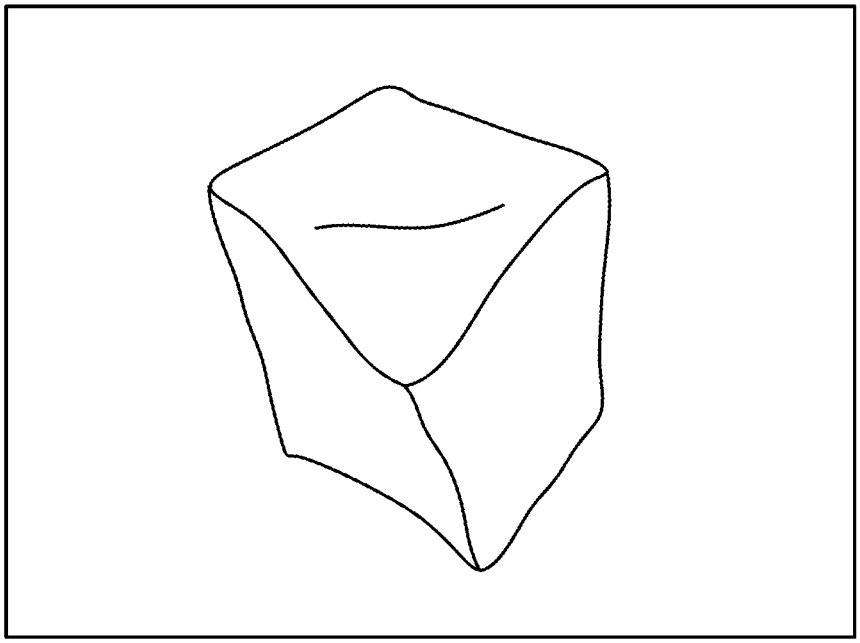
FIG. 16 shows an appearance photograph of a sample subjected to flat die forging.
Figure 17:
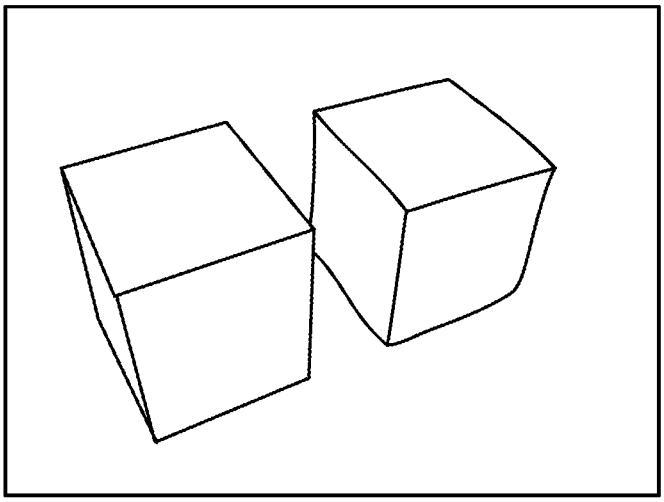
FIG. 17 shows appearance photographs of samples by using a forging die.
Figure 17:
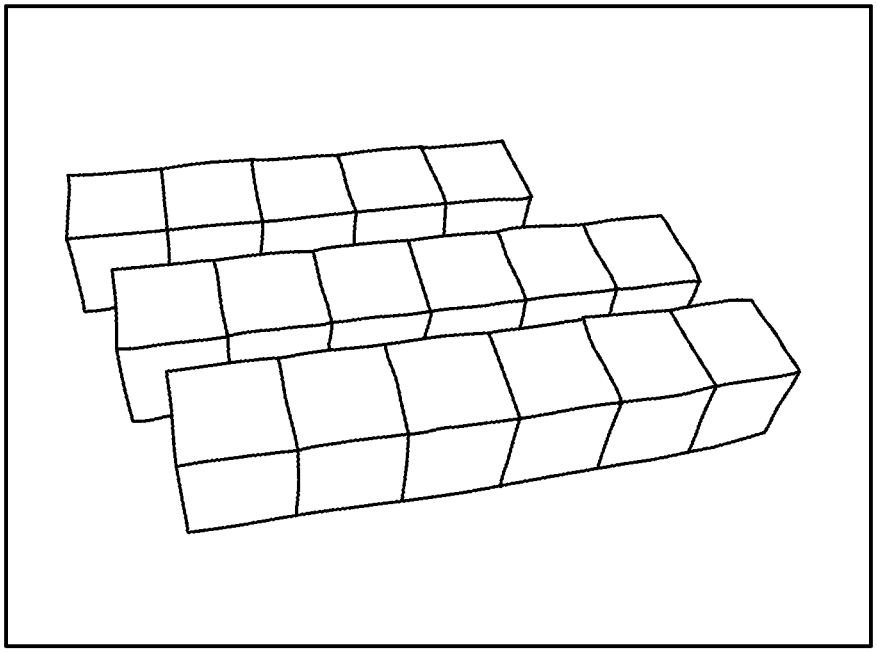

Table 2 shows the forging treatment results of each work. As shown in Table 2, Experimental Examples 14 and 15 in which the long side z and the middle side y were relatively not so longer than the short side x and Experimental Examples 16 and 17 in which the long side z and the middle side y were relatively longer than the short side x exhibited poor shape stability. Also, Experimental Example 18 in which the number of cycles of cumulative strain was small and Experimental Example 19 in which the number of cycles was large exhibited poor shape stability. Also, Experimental Example 20 in which the top surface coefficient α indicating the gap of the top surface was large exhibited good results, although the lowering of the upper die until the start of forging took a long time and it was not easy to say that the productivity was good. Meanwhile, as for Experimental Example 21 exhibiting no top surface coefficient α, forging was not performed because a movement due to backlash in insertion of the upper die indenter was feared. Also, Experimental Example 22 subjected to flat die forging without using the forging die 20 exhibited very poor shape stability. FIG. 16 shows an appearance photograph of a sample (Experimental Example 22) subjected to flat die forging. FIG. 17 shows appearance photographs of Experimental Examples 1 to 13. It was found that as for the flat die forging, if the press-forming was repeated, the surfaces of the rectangular parallelepiped shape became curved surfaces, whereas in the samples of Experimental Examples 1 to 13 subjected to the forging with the forging die 20, the rectangular parallelepiped shape was maintained even when the press-forming was repeated. As shown in Tables 1 and 2, the Cu—Be alloy, in which the top surface coefficient α was 0.01 to 0.5, $1.10x \le y \le 1.20x$ and $1.21x \le z \le 1.44x$ were satisfied with respect to short side x:middle side y:long side z ($x<y<z$), and the volume ratio was 1.22 to 2.16, exhibited good shape retention property. Meanwhile, after Experimental Examples 1 to 22, described above, were subjected to the forging treatment, the age-hardening treatment was executed. Experimental Examples 1 to 13 exhibited improved Vickers hardness measured in conformity with JIS Z2244, tensile strength measured in conformity with JIS Z2241, and the like as compared with those of Experimental Examples 14 to 22.

Also, as shown in Tables 1 and 2, the magnesium alloy (AZ31) and the iron and steel materials (Fe-20Cr and SUS304), in which the top surface coefficient α was 0.01 to 0.5, $1.22x \le y \le 1.49x$ and $1.49x \le z \le 2.22x$ were satisfied with respect to short side x:middle side y:long side z ($x<y<z$), and the volume ratio was 1.505 to 3.330, exhibited good shape retention property. Also, the aluminum alloy (7475Al), in which the top surface coefficient α was 0.01 to 0.5, $1.03x \le y \le 1.06x$ and $1.06x \le z \le 1.12x$ were satisfied with respect to short side x:middle side y:long side z ($x<y<z$), and the volume ratio was 1.07 to 1.68, exhibited good shape retention property.

TABLE 1

| | | Side Length Ratio | | | Volume Ratio | | | | |
|---|---|---|---|---|---|---|---|---|---|
| | | | | | Middle | Long | Top | | |
| No. | Work W (mass %) | Short Side ① x | Middle Side ② y | Long Side ③ z(y'2) | Side Ratio ④ y/x | Side Ratio ⑤ z/y | Top Surace Coefficient ⑥ α | Surace Gap ⑦ 1 + α | Volume Ratio ③ × ⑦/① z(1 + α)/x |
| Experimental Example 1 | Cu—1.8Be—0.2Co | 1 | 1.1 | 1.21 | 1.1 | 1.1 | 0.01 | 1.01 | 1.222 |
| Experimental Example 2 | Cu—1.8Be—0.2Co | 1 | 1.1 | 1.21 | 1.1 | 1.1 | 0.5 | 1.5 | 1.815 |
| Experimental Example 3 | Cu—1.8Be—0.2Co | 1 | 1.2 | 1.44 | 1.2 | 1.2 | 0.01 | 1.01 | 1.454 |
| Experimental Example 4 | Cu—1.8Be—0.2Co | 1 | 1.2 | 1.44 | 1.2 | 1.2 | 0.5 | 1.5 | 2.160 |
| Experimental Example 5 | Cu—1.8Be—0.2Co | 1 | 1.1 | 1.22 | 1.1 | 1.1 | 0.01 | 1.01 | 1.232 |
| Experimental Example 6 | Cu—1.8Be—0.2Co | 1 | 1.1 | 1.22 | 1.1 | 1.1 | 0.01 | 1.01 | 1.232 |
| Experimental Example 7 | Cu—1.8Be—0.2Co | 1 | 1.1 | 1.22 | 1.1 | 1.1 | 0.01 | 1.01 | 1.232 |
| Experimental Example 8 | Cu—1.8Be—0.2Co | 1 | 1.1 | 1.22 | 1.1 | 1.1 | 0.01 | 1.01 | 1.232 |
| Experimental Example 9 | Cu—1.8Be—0.2Co | 1 | 1.1 | 1.22 | 1.1 | 1.1 | 0.01 | 1.01 | 1.232 |
| Experimental Example 10 | Cu—1.8Be—0.2Co | 1 | 1.1 | 1.22 | 1.1 | 1.1 | 0.01 | 1.01 | 1.232 |
| Experimental Example 11 | Cu—1.8Be—0.2Co | 1 | 1.1 | 1.22 | 1.1 | 1.1 | 0.01 | 1.01 | 1.232 |
| Experimental Example 12 | Cu—1.8Be—0.2Co | 1 | 1.1 | 1.22 | 1.1 | 1.1 | 0.01 | 1.01 | 1.232 |
| Experimental Example 13 | Cu—1.8Be—0.2Co | 1 | 1.1 | 1.22 | 1.1 | 1.1 | 0.2 | 1.2 | 1.232 |
| Experimental Example 14 | Cu—1.8Be—0.2Co | 1 | 1.05 | 1.10 | 1.05 | 1.05 | 0.01 | 1.01 | 1.111 |
| Experimental Example 15 | Cu—1.8Be—0.2Co | 1 | 1.05 | 1.10 | 1.05 | 1.05 | 0.5 | 1.5 | 1.650 |
| Experimental Example 16 | Cu—1.8Be—0.2Co | 1 | 1.22 | 1.49 | 1.22 | 1.22 | 0.01 | 1.01 | 1.505 |
| Experimental Example 17 | Cu—1.8Be—0.2Co | 1 | 1.3 | 1.69 | 1.3 | 1.3 | 0.01 | 1.01 | 1.707 |
| Experimental Example 18 | Cu—1.8Be—0.2Co | 1 | 1.1 | 1.22 | 1.1 | 1.1 | 0.01 | 1.01 | 1.232 |
| Experimental Example 19 | Cu—1.8Be—0.2Co | 1 | 1.1 | 1.22 | 1.1 | 1.1 | 0.01 | 1.01 | 1.232 |

TABLE 1-continued

| No. | Work W (mass %) | Side Length Ratio: Short Side ① x | Side Length Ratio: Middle Side ② y | Side Length Ratio: Long Side ③ z(y'2) | Volume Ratio: Middle Side Ratio ④ y/x | Volume Ratio: Long Side Ratio ⑤ z/y | Volume Ratio: Top Surace Coefficient ⑥ α | Volume Ratio: Top Surace Gap ⑦ 1 + α | Volume Ratio: Top Volume Ratio ③ × ⑦/① z(1 + α)/x |
|---|---|---|---|---|---|---|---|---|---|
| Experimental Example 20 | Cu—1.8Be—0.2Co | 1 | 1.1 | 1.22 | 1.1 | 1.1 | 0.6* | 1.6 | 1.952 |
| Experimental Example 21 | Cu—1.8Be—0.2Co | 1 | 1.1 | 1.22 | 1.1 | 1.1 | 0* | 1 | 1.220 |
| Experimental Example 22 | Cu—1.8Be—0.2Co | 1 | 1.1 | 1.22 | 1.1 | 1.1 | Flat Die Forging | | |
| Experimental Example 23 | Cu—1.8Ni—0.35Be | 1 | 1.1 | 1.22 | 1.1 | 1.1 | 0.01 | 1.01 | 1.232 |
| Experimental Example 24 | Cu—15Ni—7Sn | 1 | 1.1 | 1.22 | 1.1 | 1.1 | 0.01 | 1.01 | 1.232 |
| Experimental Example 25 | Cu—3Ti—0.1Fe | 1 | 1.1 | 1.22 | 1.1 | 1.1 | 0.01 | 1.01 | 1.232 |
| Experimental Example 26 | Cu—9Ni—2Si | 1 | 1.1 | 1.22 | 1.1 | 1.1 | 0.01 | 1.01 | 1.232 |
| Experimental Example 27 | AZ31 | 1 | 1.22 | 1.49 | 1.22 | 1.22 | 0.01 | 1.01 | 1.505 |
| Experimental Example 28 | AZ31 | 1 | 1.49 | 2.22 | 1.49 | 1.49 | 0.5 | 1.5 | 3.330 |
| Experimental Example 29 | Fe—20Cr | 1 | 1.22 | 1.49 | 1.22 | 1.22 | 0.01 | 1.01 | 1.505 |
| Experimental Example 30 | SUS304 | 1 | 1.49 | 2.22 | 1.49 | 1.49 | 0.01 | 1.01 | 2.242 |
| Experimental Example 31 | 7475Al | 1 | 1.03 | 1.06 | 1.03 | 1.03 | 0.01 | 1.01 | 1.071 |
| Experimental Example 32 | 7475Al | 1 | 1.06 | 1.12 | 1.06 | 1.06 | 0.5 | 1.5 | 1.680 |

* In Experimental Example 20, aothough the results were good, lowering of upper die until the start of forging tool a long time and the prosuctivity was not good.

* In Experimental Example 21, forging was not performed because a movement due to backlash in isertion of the upper die indenter was feared, although good results are expected.

TABLE 2

| No. | Work W (mass %) | Working Ratio-Deformation Amount: Strain at Pass Δε (In(z)) In(z) | Δε (In(z)) % | Accumulative Amount of Strain ΣΔε Number of Cycles | ΣΔε | Result: Shape ○ (Good) X (Poor) | Linearity ○ (Good) X (Deformed) | Maximum Dimensional Difference ○ (≤2%) X (>2%) |
|---|---|---|---|---|---|---|---|---|
| Experimental Example 1 | Cu—1.8Be—0.2Co | 0.19 | 17 | 3 | 1.71 | ○ | ○ | ○ |
| Experimental Example 2 | Cu—1.8Be—0.2Co | 0.19 | 17 | 3 | " | ○ | ○ | ○ |
| Experimental Example 3 | Cu—1.8Be—0.2Co | 0.36 | 31 | 3 | 3.24 | ○ | ○ | ○ |
| Experimental Example 4 | Cu—1.8Be—0.2Co | 0.36 | 31 | 3 | " | ○ | ○ | ○ |
| Experimental Example 5 | Cu—1.8Be—0.2Co | 0.20 | 18 | 3 | 1.8 | ○ | ○ | ○ |
| Experimental Example 6 | Cu—1.8Be—0.2Co | 0.20 | 18 | 2 | 1.2 | ○ | ○ | ○ |
| Experimental Example 7 | Cu—1.8Be—0.2Co | 0.20 | 18 | 4 | 2.4 | ○ | ○ | ○ |
| Experimental Example 8 | Cu—1.8Be—0.2Co | 0.20 | 18 | 5 | 3.0 | ○ | ○ | ○ |
| Experimental Example 9 | Cu—1.8Be—0.2Co | 0.20 | 18 | 6 | 3.6 | ○ | ○ | ○ |
| Experimental Example 10 | Cu—1.8Be—0.2Co | 0.20 | 18 | 10 | 6.0 | ○ | ○ | ○ |
| Experimental Example 11 | Cu—1.8Be—0.2Co | 0.20 | 18 | 12 | 7.2 | ○ | ○ | ○ |
| Experimental Example 12 | Cu—1.8Be—0.2Co | 0.20 | 18 | 13 | 7.8 | ○ | ○ | ○ |
| Experimental Example 13 | Cu—1.8Be—0.2Co | 0.20 | 18 | 3 | 1.8 | ○ | ○ | ○ |
| Experimental Example 14 | Cu—1.8Be—0.2Co | 0.098 | 9 | 3 | 0.88 | X | X | X |
| Experimental Example 15 | Cu—1.8Be—0.2Co | 0.098 | 9 | 3 | 0.88 | X | X | X |
| Experimental Example 16 | Cu—1.8Be—0.2Co | 0.40 | 33 | 3 | 3.8 | X | X | X |
| Experimental Example 17 | Cu—1.8Be—0.2Co | 0.52 | 41 | 3 | 4.66 | X | X | X |
| Experimental Example 18 | Cu—1.8Be—0.2Co | 0.20 | 18 | 1 | 0.6 | X | X | X |
| Experimental Example 19 | Cu—1.8Be—0.2Co | 0.20 | 18 | 14 | 8.4 | X | X | X |
| Experimental Example 20 | Cu—1.8Be—0.2Co | 0.20 | 18 | 3 | 8.4 | ○ | ○ | ○ |
| Experimental Example 21 | Cu—1.8Be—0.2Co | 0.20 | 18 | 3 | 8.4 | — | — | — |
| Experimental Example 22 | Cu—1.8Be—0.2Co | 0.20 | 18 | 3 | 1.8 | X | X | X |
| Experimental Example 23 | Cu—1.8Ni—0.35Be | 0.20 | 18 | 3 | 1.8 | ○ | ○ | ○ |
| Experimental Example 24 | Cu—15Ni—7Sn | 0.20 | 18 | 3 | 1.8 | ○ | ○ | ○ |
| Experimental Example 25 | Cu—3Ti—0.1Fe | 0.20 | 18 | 3 | 1.8 | ○ | ○ | ○ |
| Experimental Example 26 | Cu—9Ni—2Si | 0.20 | 18 | 3 | 1.8 | ○ | ○ | ○ |
| Experimental Example 27 | AZ31 | 0.40 | 33 | 3 | 1.8 | ○ | ○ | ○ |
| Experimental Example 28 | AZ31 | 0.80 | 55 | 3 | 1.8 | ○ | ○ | ○ |
| Experimental Example 29 | Fe—20Cr | 0.40 | 33 | 3 | 1.8 | ○ | ○ | ○ |
| Experimental Example 30 | SUS304 | 0.80 | 55 | 3 | 1.8 | ○ | ○ | ○ |
| Experimental Example 31 | 7475Al | 0.06 | 6 | 3 | 1.8 | ○ | ○ | ○ |
| Experimental Example 32 | 7475Al | 0.11 | 11 | 3 | 1.8 | ○ | ○ | ○ |

In this regard, even when the die, e.g., the forging die 20C, in which the inner die was not divided was used, the forging treatment was able to be executed while the shape stability was high as with the above-described examples. However, in some cases, a stress was applied to the inner die, and cracking occurred in the corner portion of the inner die forming the work space. On the other hand, it was found that as for the forging die 20 in which the inner die 50 was composed of the plurality of die members, such cracking did not occur and a stable forging treatment was able to be executed.

The present application claims priority from Japanese Patent Application No. 2012-072259 filed on Mar. 27, 2012, the entire contents of which are incorporated herein by reference.

INDUSTRIAL APPLICABILITY

The present invention can be utilized for machine structural parts, e.g., aircraft bearings, casings of submarine cable repeaters, rotor shafts of ships, collars of oil field excavation drills, injection molding dies, and welding electrode holders, which are required to have the durability and the reliability.

What is claimed is:

1. A forging method comprising:

a placement step of placing a work having a first shape which is a rectangular hexahedron in a work space of a forging die, the forging die comprising the work space having a rectangular opening, being formed by rectangular plane wall portions, and being provided for holding the work, a substantially vertically-slidable upper die indenter, and a substantially-horizontally slidable pedestal portion defining a bottom of the work space, wherein a space communicating to outside of the work space is formed by sliding the pedestal portion; and a working step of applying, with the upper die indenter and the pedestal portion, a plastic strain to the work by deforming the placed work into a second shape which is a rectangular hexahedron, wherein placing the work in the work space of the forging die and applying, with the upper die indenter and the slidable pedestal portion of the plastic strain at least two times deforms the work in the x-axis direction, the y-axis direction, and the z-axis direction.

2. The forging method according to claim 1, wherein the forging die includes an outer die which has a circular opening and which is provided with the inner peripheral surface of the circle and an inner die which forms the work space while a plurality of die parts of the inner die are combined and are fitted into the inner periphery of the outer die.

3. The forging method according to claim 1, wherein in the forging die, an inner die is composed of a plurality of die parts which are separated from each other at corner portions formed by two planes of the work space.

4. The forging method according to claim 1, wherein the forging die includes a base portion constituting the bottom of the work space, and the base portion is provided with a flow path, through which a cooling medium passes.

5. The forging method according to claim 1, wherein in the placement step, the work and the work space define a volume ratio, the volume ratio being a ratio of a volume of the work space to a volume of the work, within a range of 1.20 or more and 3.50 or less.

6. The forging method according to claim 1, wherein during the placement step, the ratio of lengths of the individual sides (side X, side Y, and side Z) of the work are x:y:z, the volume ratio of the work space to the work is within a range of $(y/x)\times(z/y)\times z(1+\alpha)/z$; (where $x<y<z$, $1.03x\leq y\leq 1.49x$, $1.06x\leq z\leq 2.22x$, $z=(y/x)^2x$, and $0<\alpha\leq 0.5$ are satisfied), and during the working step, a pressure is applied by the upper die indenter against an upper surface of the work to press in by an amount of $(z-x)$.

7. The forging method according to claim 6, wherein during the placement step, the range is $1.10x\leq y\leq 1.20x$ and $1.21x\leq z\leq 1.44x$.

8. The forging method according to claim 1, wherein during the working step, the work is deformed at a working ratio, the working ratio being an amount of work deformation divided by an original dimension of the work, expressed as an amount of strain, is within the range of 6% or more and less than 55%.

9. The forging method according to claim 8, wherein during the working step, the work is deformed at the working ratio is within the range of 18% or more and less than 33%.

10. The forging method according to claim 1, wherein the work is an alloy containing Be and Cu.

11. The forging method according to claim 1, wherein after placing the work in the work space of the forging die and applying, with the upper die indenter and the slidable pedestal portion, the plastic strain at least two times the work having the first shape and the work having the second shape are different in length in the x-axis direction, the y-axis direction, and the z-axis direction.

12. The forging method according to claim 1, wherein the forging die further comprises an inner die that is composed of a plurality of die parts having a concave portion and a convex portion that are fitted with each other to form an integral structure of the inner die.

13. A forging die used in a forging method that applies a plastic strain to a work by deforming the work having a first shape which is a rectangular hexahedron into a work having a second shape which is a rectangular hexahedron, the forging die comprising:

an outer die which has a circular opening and which is provided with the inner peripheral surface of the circle;

an inner die which has a rectangular opening and in which a work space for holding the work is formed by rectangular plane wall portions while a plurality of die parts are combined and are fitted into the inner periphery of the outer die;

a substantially-vertically slidable upper die indenter positioned to be slidable into the work space; and a slidable pedestal portion defining a bottom of the work space, and positioned to be slidable into the work space;

wherein a space communicating to outside of the work space is formed by sliding the pedestal portion; and wherein the outer die, the inner die, the upper die indenter, and the slidable pedestal portion are configured, after placing the work in the work space and applying a strain thereto with the upper die indenter and the slidable pedestal portion at least two times, the work is deformed in the x-axis direction, the y-axis direction, and the z-axis direction.

14. The forging die according to claim 13, wherein the inner die is composed of the plurality of die parts which are separated from each other at corner portions formed by two planes of the work space.

15. The forging die according to claim 13, comprising a base portion constituting the bottom of the work space, wherein the base portion is provided with a flow path, through which a cooling medium passes.

16. The forging die according to claim 13, comprising:

a base portion defining a bottom of the work space, and a lift mechanism which is disposed in the base portion and which lifts the work by pushing the bottom of the work held in the work space.

17. The forging die according to claim 13, wherein the inner die is composed of the plurality of die parts having a concave portion and a convex portion that are fitted with each other to form an integral structure of the inner die.

* * * * *